US010865606B2

(12) United States Patent
Massey et al.

(10) Patent No.: US 10,865,606 B2
(45) Date of Patent: Dec. 15, 2020

(54) DOWNHOLE CENTRALIZER

(71) Applicant: Impact Selector International, LLC, Houma, LA (US)

(72) Inventors: James Patrick Massey, Breckenridge, CO (US); Brandon Martin, Forney, TX (US)

(73) Assignee: IMPACT SELECTOR INTERNATIONAL, LLC, Houma, LA (US)

( * ) Notice: Subject to any disclaimer, the term of this patent is extended or adjusted under 35 U.S.C. 154(b) by 0 days.

(21) Appl. No.: 16/444,672

(22) Filed: Jun. 18, 2019

(65) Prior Publication Data

US 2019/0383108 A1 Dec. 19, 2019

Related U.S. Application Data

(60) Provisional application No. 62/686,090, filed on Jun. 18, 2018.

(51) Int. Cl.
*E21B 17/10* (2006.01)
*E21B 47/092* (2012.01)

(52) U.S. Cl.
CPC ..... *E21B 17/1021* (2013.01); *E21B 47/092* (2020.05)

(58) Field of Classification Search
CPC ..... E21B 17/1021
See application file for complete search history.

(56) References Cited

U.S. PATENT DOCUMENTS

| | | | | |
|---|---|---|---|---|
| 5,005,642 | A † | 4/1991 | Moore | |
| 5,758,723 | A | 6/1998 | Saucier et al. | |
| 2003/0173076 | A1 † | 9/2003 | Sheiretov | |
| 2005/0279498 | A1 | 12/2005 | Nakajima et al. | |
| 2007/0181298 | A1 * | 8/2007 | Sheiretov | E21B 17/1021 166/212 |
| 2009/0236101 | A1 * | 9/2009 | Nelson | E21B 4/18 166/382 |

(Continued)

FOREIGN PATENT DOCUMENTS

WO 2019246105 A1 12/2019

OTHER PUBLICATIONS

PCT/US2019/037743 ISI-022PCT; Written Opinion/Search Report dated Nov. 15, 2019, 11 pages.

(Continued)

*Primary Examiner* — Kristyn A Hall
*Assistant Examiner* — Dany E Akakpo
(74) *Attorney, Agent, or Firm* — Boisbrun Hofman, PLLC

(57) ABSTRACT

A downhole centralizer operable to be coupled with a tool string and conveyed within a downhole passage, wherein the downhole passage is a wellbore or a tubular member disposed in the wellbore. The downhole centralizer may have a plurality of arms that are operable to move against a sidewall of the downhole passage to centralize at least a portion of the tool string within the downhole passage, impart an intended force against the sidewall of the downhole passage, and maintain the intended force substantially constant while the tool string is conveyed along the downhole passage and an inner diameter of the downhole passage changes.

24 Claims, 7 Drawing Sheets

(56) References Cited

U.S. PATENT DOCUMENTS

2019/0301258 A1* 10/2019 Li ..... E21B 47/0002

OTHER PUBLICATIONS

Press Release titled Unique technology and foreign market ties prove key to success for Alberta Export Award winner, dated Sep. 20, 2017, author Smith.†

Field Operations & Maintenance Manual from Hunter Well Science, author Barratt, titled, Field Operations & Maintenance Manual HAC001 Helical 4 Arm Centraliser., dated Feb. 22, 2012 (copyright 2011).†

* cited by examiner
† cited by third party

DOWNHOLE CENTRALIZER

CROSS-REFERENCE TO RELATED APPLICATIONS

This application claims priority to and the benefit of U.S. Provisional Application No. 62/686,090, titled "DOWNHOLE CENTRALIZER," filed Jun. 18, 2018, the entire disclosure of which is hereby incorporated herein by reference.

BACKGROUND OF THE DISCLOSURE

Oil and gas wells are generally drilled into a land surface or ocean bed to recover natural deposits of oil, gas, and other natural resources that are trapped in geological formations in the Earth's crust. Measurements of formation pressure and permeability, analysis of formation fluid samples, and other information about a formation may be utilized for predicting economic value, production capacity, and production lifetime of the formation. Testing and evaluation of completed and partially constructed wells has also become commonplace, such as to increase well production and return on investment. Construction of oil and gas wells may include securing a metal casing within a wellbore via cement forming an annular structure between a sidewall of the wellbore and an outer diameter of the casing. Information about quality of a well, such as weld quality and cement bond quality, may be utilized to determine if the well is constructed according to specifications and/or if portions of the well have to be repaired. Furthermore, intervention operations in completed wells, such as installation, removal, or replacement of various production equipment, may be performed as part of well repair or maintenance operations or permanent abandonment.

Certain downhole tools utilized to test subterranean formations, evaluate wells, and/or perform intervention operations may operate optimally when centered within a wellbore. For example, downhole acoustic tools may be utilized for cement bond logging (CBL) to evaluate bonding quality between casing and cement, such as by evaluating amplitudes of casing arrivals traveling from a transmitter to the casing and refracted to a sensor axially separated from the transmitter. Downhole acoustic tools may also or instead be utilized for radial bond logging (RBL) to evaluate azimuthal variation of cement bonding, such as by evaluating casing arrivals across sensors at various azimuthal locations around a downhole acoustic tool. However, CBL and RBL both resort to casing arrival amplitudes, which are sensitive to the position of the downhole acoustic tool within the casing. Consequently, eccentering of the downhole acoustic tool from the central axis of the casing perturbs casing arrival amplitudes, which can result in inaccurate interpretation of the cement bonding quality.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
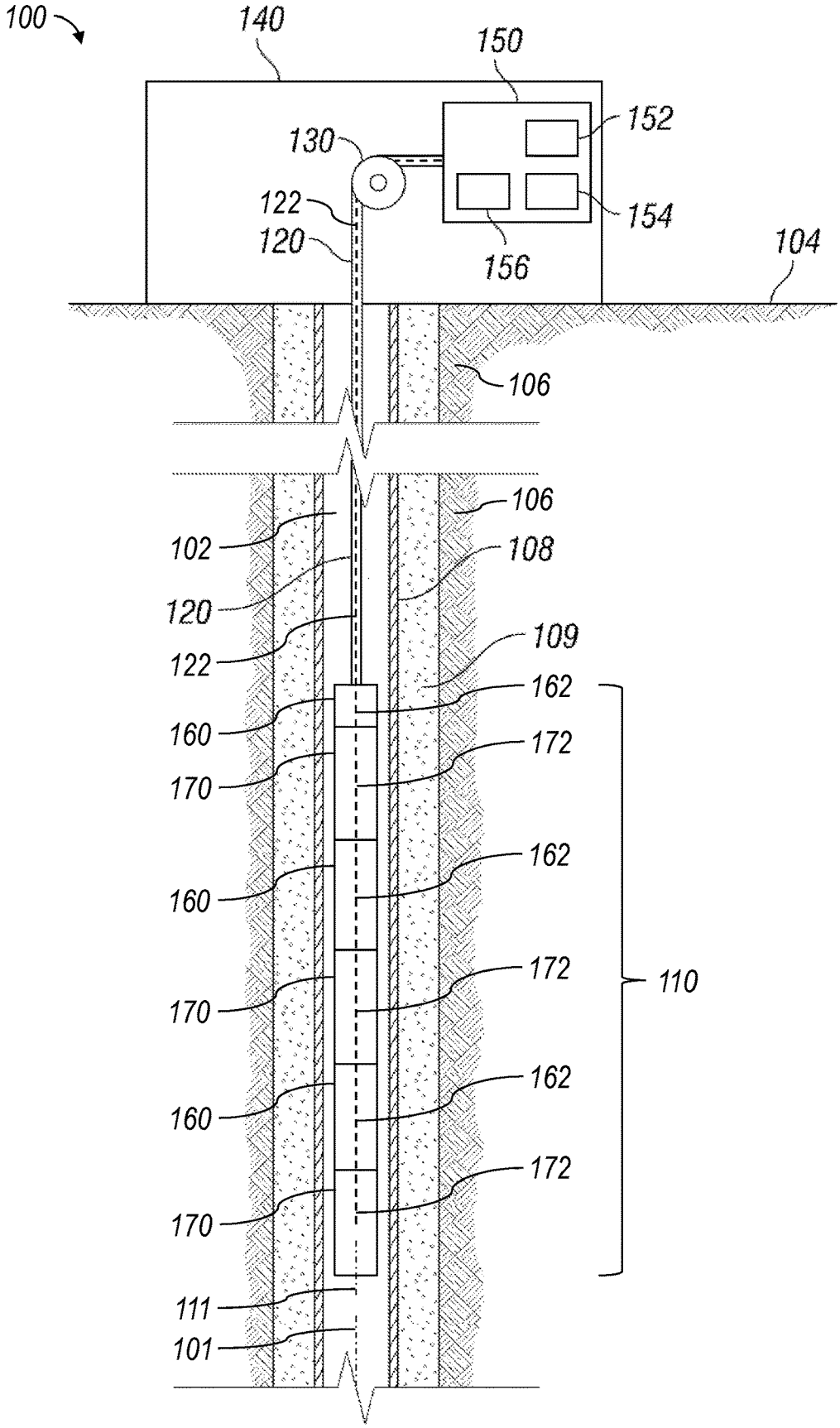
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

FIG. 1 is a schematic view of at least a portion of a wellsite system 100 showing an example environment comprising or utilized in conjunction with a downhole tool string 110 according to one or more aspects of the present disclosure. The tool string 110 may be suspended within a wellbore 102 that extends from a wellsite surface 104 into one or more subterranean formations 106. The wellbore 102 may be a cased-hole implementation comprising a casing 108 secured by cement 109. However, one or more aspects of the present disclosure are also applicable to and/or readily adaptable for utilizing in open-hole implementations lacking the casing 108 and cement 109. The tool string 110 may be suspended within the wellbore 102 via a conveyance means 120 operably coupled with a tensioning device 130 and/or other surface equipment 140 disposed at the wellsite surface 104. The tool string 110 is shown suspended in a vertical portion of the wellbore 102, however, it is to be understood that the tool string 110 may be utilized within a non-vertical, horizontal, and otherwise deviated portion of the wellbore 102.

The tensioning device 130 may apply an adjustable tensile force to the tool string 110 via the conveyance means 120 to convey the tool string 110 along the wellbore 102. The tensioning device 130 may be, comprise, or form at least a portion of a crane, a winch, a draw-works, an injector, a top drive, and/or another lifting device coupled to the tool string 110 via the conveyance means 120. The conveyance means 120 may be or comprise a wireline, a slickline, an e-line, coiled tubing, and/or other conveyance means, and may comprise and/or be operable in conjunction with means for communication between the tool string 110, the tensioning device 130, and/or one or more other portions of the surface equipment 140, including a power and control system 150. The conveyance means 120 may comprise or contain a multi-conductor wireline and/or another electrical conductor 122 extending between the tool string 110 and the surface equipment 140. The power and control system 150 may include a source of electrical power 152, a memory device 154, and a surface controller 156 operable to receive and process electrical signals or information from the tool string 110 and/or commands from a human wellsite operator.

The tool string 110 may comprise at least a portion of one or more downhole apparatus, modules, and/or other tools 160 operable in wireline, coiled tubing, completion, production, and/or other implementations. For example, the downhole tools 160 may each be or comprise one or more of an acoustic tool, a cutting tool, a density tool, a directional tool, an electrical power module, an electromagnetic (EM) tool, a formation testing tool, a fluid sampling tool, a gravity tool, a formation logging tool, a hydraulic power module, a magnetic resonance tool, a formation measurement tool, a jarring tool, a mechanical interface tool, a monitoring tool, a neutron tool, a nuclear tool, a perforating tool, a photoelectric factor tool, a plug setting tool, a porosity tool, a power module, a ram, a reservoir characterization tool, a resistivity tool, a seismic tool, a stroker tool, and/or a surveying tool, among other examples also within the scope of the present disclosure.

One or more of the downhole tools 160 may also or instead comprise a telemetry tool, such as may facilitate communication between the tool string 110 and the surface equipment 140. The telemetry tool may comprise inclination sensors and/or other sensors, such as one or more accelerometers, magnetometers, gyroscopic sensors (e.g., microelectro-mechanical system (MEMS) gyros), and/or other sensors for determining the orientation of the tool string 110 relative to the wellbore 102. The telemetry tool may comprise a depth correlation tool, such as a casing collar locator (CCL) for detecting ends of casing collars by sensing a magnetic irregularity caused by the relatively high mass of an end of a collar of the casing 108. The correlation tool may also or instead be or comprise a gamma ray (GR) tool that may be utilized for depth correlation. The CCL and/or GR may be utilized to determine the position of the tool string 110 or portions thereof, such as with respect to known casing collar numbers and/or positions within the wellbore 102. Therefore, the CCL and/or GR tools may be utilized to detect and/or log the location of the tool string 110 within the wellbore 102, such as during deployment within the wellbore 102 or other downhole operations. An uppermost downhole tool 160 of the tool string 110 may be or comprise a cable head, which may be operable to connect the conveyance means 120 with the tool string 110.

The tool string 110 may further comprise one or more centralizing tools 170 (referred to hereinafter as "centralizers") coupled with, between, and/or on opposing sides of the downhole tools 160. Each centralizer 170 may be selectively operable to centralize at least a portion of itself within the wellbore 102 and, thus, centralize a downhole tool 160 or at least a portion of the tool string 110 coupled with the centralizer 170. For example, each centralizer 170 may be operable to centralize one or more of the downhole tools 160 or at least a portion of the tool string 110 such that a central axis 111 of a centralized one or more of the downhole tools 160 or a centralized portion of the tool string 110 is positioned substantially at, along, in alignment with, or coinciding with a central axis 101 of the wellbore 102.

The centralizers 170 may be coupled directly or indirectly with a downhole tool 160 intended to be centralized. Two centralizers 170 may be coupled on opposing sides of one or more downhole tools 160 intended to be centralized. Although FIG. 1 depicts the tool string 110 comprising three centralizers 170 directly coupled with three downhole tools 160, it is to be understood that the tool string 110 may include one, two, four, or more centralizers 170, each or collectively operable to centralize a downhole tool 160, a portion of the tool string 110, or the entire tool string 110. It is further to be understood that the tool string 110 may comprise one, two, four, or more downhole tools 160, of which one or more may be intended to be centralized by one or more centralizers 170. Thus, a plurality of centralizers 170 may be coupled along the tool string 110, for example, if a plurality of downhole tools 160 intended to be centralized are coupled along the tool string 110 and/or if the entire tool string 110 is intended to be centralized. Thus, a plurality of centralizers 170 may be collectively operable to centralize the entire tool string 110 such that the central axis 111 of the tool string 110 is substantially aligned with the central axis 101 of the wellbore 102.

Each downhole tool 160 may comprise or contain at least one electrical conductor 162 and each centralizer 170 may comprise or contain at least one electrical conductor 172. The electrical conductors 162, 172 may be interconnected and an uppermost conductor 162, 172 may be connected with the conductor 122. Thus, one or more of the downhole tools 160 and centralizers 170 may be electrically and/or communicatively connected with one or more components of the surface equipment 140, such as the power and control system 150, via the electrical conductors 122, 162, 172. The electrical conductors 122, 162, 172 may transmit and/or receive electrical power, signals, information, and/or control commands between the power and control system 150 and one or more of the downhole tools 160 and/or centralizers 170. The conductors 162, 172 may further facilitate electrical communication between two or more of the downhole tools 160 and/or centralizers 170. Each of the downhole tools 160, the centralizers 170, and/or portions thereof may comprise one or more electrical connectors and/or interfaces, such as may mechanically, electrically, and/or communicatively connect the electrical conductors 122, 162, 172.

Figure 2:
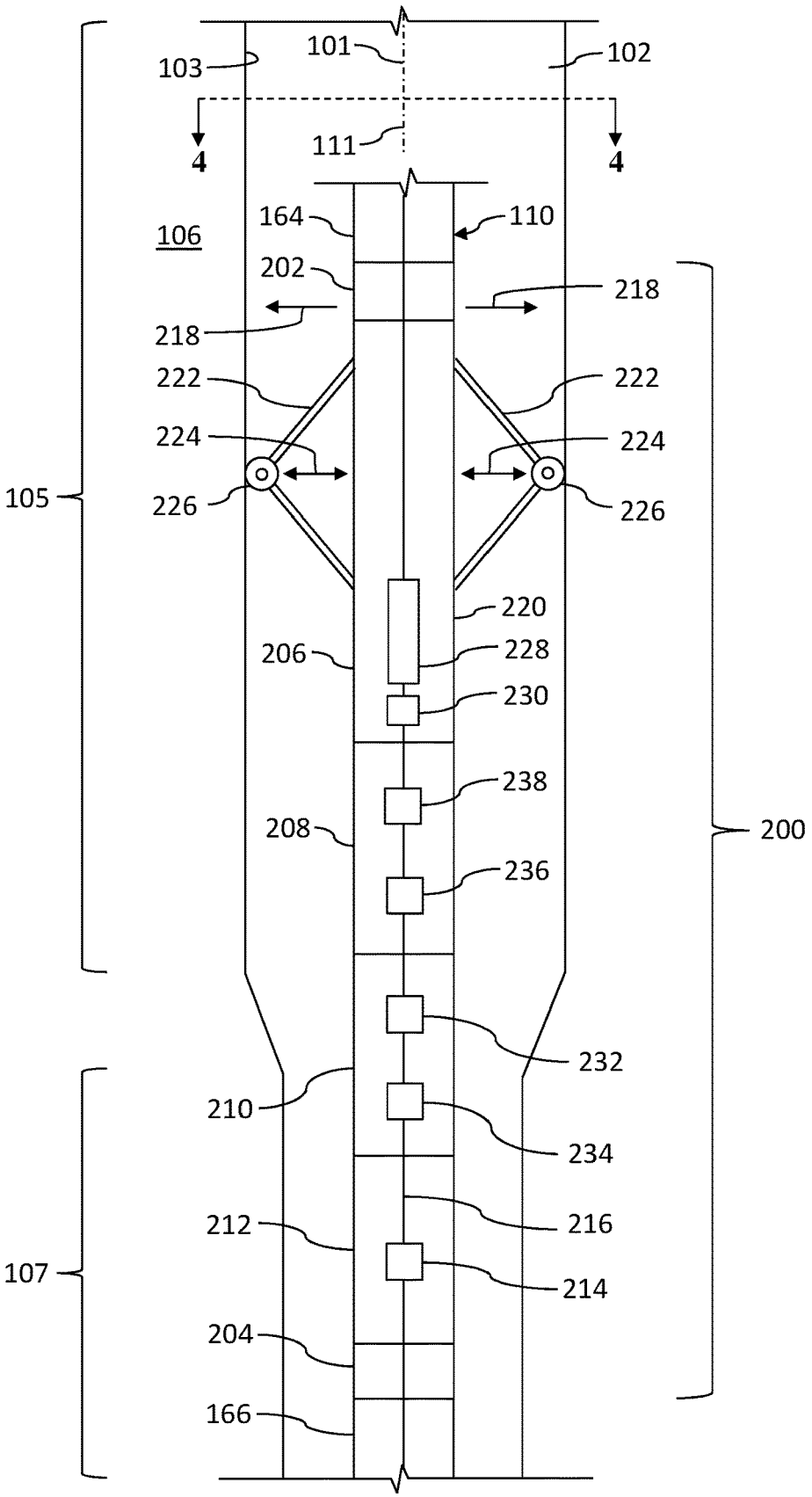
FIG. 2 is a schematic view of at least a portion of an example implementation of apparatus according to one or more aspects of the present disclosure.

FIG. 2 is a schematic side view of a portion of a tool string 110 conveyed within a wellbore 102 and comprising an example implementation of a centralizer 200 according to one or more aspects of the present disclosure. The tool string 110 and centralizer 200 may comprise one or more features of the tool string 110 and centralizer 170, respectively, described above and shown in FIG. 1, except as described below. The following description refers to FIGS. 1 and 2, collectively.

An upper end of the centralizer 200 may include an interface, a sub, a crossover, and/or another coupler 202 for mechanically and/or electrically coupling the centralizer 200 with a corresponding interface (not shown) of a downhole tool 164 or another portion of the tool string 110. A lower end of the centralizer 200 may include an interface, a sub, a crossover, and/or another coupler 204 for mechanically and/or electrically coupling with a corresponding interface (not shown) of a downhole tool 166 or another portion of the tool string 110.

The centralizer 200 may further comprise a positioning module or section 206, a mechanical control module or section 208, a power module or section 210, and an electrical control module or section 212. A conductor 216 may extend between the upper and lower couplers 202, 204, such as may electrically and/or communicatively connect one or more of the sections 206, 208, 210, 212 of the centralizer 200 with other portions of the tool string 110 and/or the surface equipment 140, such as the power and control system 150.

The positioning section 206 may be operable to move laterally (e.g., radially, in a transverse or perpendicular direction) with respect to the central axis 101 of the wellbore 102, as indicated by arrows 218, and, thus, operable to move laterally with respect to the central axis 101 of the wellbore 102 at least a portion of the downhole tool 164, the downhole tool 166, and/or the tool string 110 coupled with the positioning section 206 or otherwise with the centralizer 200.

The positioning section 206 may thus be operable to substantially centralize at least a portion of the downhole tool 164, the downhole tool 166, and/or the tool string 110 within the wellbore 102 such that a central axis 111 of the downhole tool 164, the downhole tool 166, and/or the tool string 110 intended to be centralized is positioned substantially at, along, in alignment with and/or intercepts the central axis 101 of the wellbore 102. The positioning section 206 may comprise a body 220 and a plurality of arms 222 each operable to extend away from and retract toward the body 220 (i.e., move radially or laterally with respect to the central axis 111) against a sidewall 103 (e.g., casing 108, rock formation 106) of the wellbore 102, as indicated by arrows 224, to laterally move and centralize the positioning section 206 and an intended downhole tool 164, 166 and/or the tool string 110 within the wellbore 102. Each arm 222 may terminate with a roller or another contact member 226 operable to roll, slide, or otherwise reduce friction between the arms 222 and the sidewall 103 of the wellbore 102. The friction reducing contact members 226 may permit the tool string 200, including the downhole tools 164, 166 to move axially (e.g., roll, slide) along the wellbore 102 while being centralized by the centralizer 200. The centralizer 200 shown in FIG. 2 comprises three arms 222, wherein the third arm 222 is obstructed from view. However, it is to be understood that the centralizer 200 within the scope of the present disclosure may include four or more arms 222 operable to extend laterally against the sidewall 103 of the wellbore 102.

The positioning section 206 may further comprise one or more actuators 228 operably connected with the arms 222 and operable to extend and retract the arms 222 to move the positioning section 206 and an intended portion of the tool string 110 laterally within the wellbore 102. The actuator 228 may be or comprise a hydraulic ram, a hydraulic motor, a linear electric actuator, and/or an electric motor, among other examples. The positioning section 206 may further comprise a position sensor 230 operable to output a signal or information indicative of radial position (i.e., lateral position, extension) of the arms 222. The sensor 230 may be disposed in association with the arms 222 in a manner permitting sensing of the position of the arms 222. However, the sensor 230 may be disposed in association with the actuator 228 or another portion of the positioning section 206 in a manner permitting sensing of the position of the actuator 228 and/or the another portion of the positioning section 206, which may be used to determine the position of the arms 222. The sensor 230 may be or comprise a linear encoder, a linear potentiometer, a capacitive sensor, an inductive sensor, a magnetic sensor, a linear variable-differential transformers (LVDT), a proximity sensor, a Hall effect sensor, and/or a reed switch, among other examples.

While the tool string 110 is conveyed along the wellbore 102, the arms 222 of the centralizer 200 may be operable to apply or otherwise impart an intended (e.g., predetermined, selected, set) radial setting force against the sidewall 103 of the wellbore 102. The radial setting force may be selected based on several considerations. For example, the radial setting force may be selected based on mass of the tool string 110, such as may facilitate lateral movement and centralizing of the tool string 110. The radial setting force may be selected based on structural properties or limits of the arms 222, such as may prevent bending or other damage to the arms 222. The radial setting force may be selected based on structural properties or limits of the contact members 226. The radial setting force may be selected based on downhole conditions (e.g., density, viscosity, and/or composition of fluid within the wellbore 102, friction properties of the sidewall 103), such as to facilitate uninhibited axial movement along the wellbore 102 (e.g., by preventing or inhibiting friction that may cause the tool string 110 to stall within the wellbore 102). The arms 222 may also be operable to maintain the intended radial setting force imparted to the sidewall 103 at a substantially constant level while the tool string 110 is conveyed along the wellbore 102 and inner cross-sectional diameter of the wellbore 102 changes. For example, the arms 222 may apply substantially the same intended radial setting force against the sidewall 103 while the centralizer 200 and the arms 222 pass from a wider wellbore section 105 into a narrower wellbore section 107.

The radial setting force applied by the centralizer 200 may be set (e.g., implemented, programmed, calibrated) while the centralizer 200 is at the wellsite surface 104. The radial setting force applied by the centralizer 200 may be set while the centralizer 200 is conveyed within the wellbore 102 from the wellsite surface 104 via the electrical conductors 122, 216. The radial setting force applied by the centralizer 200 may be changed while the centralizer 200 is conveyed within the wellbore 102 from the wellsite surface 104 via the electrical conductors 122, 216, such as when downhole conditions change.

The power section 210 may be operable to provide power to or otherwise drive the positioning section 206 to cause the arms 222 to apply the intended radial setting force. For example, the power section 210 may be or comprise a hydraulic power pack, which may be operable to supply hydraulic power to the positioning section 206. The hydraulic power pack may comprise a hydraulic pump 232 operable to provide pressurized hydraulic fluid to the actuator 228 to extend and retract the arms 222, as described herein. The power section 210 may also or instead be or comprise an electrical power source 234, such as a battery. The battery may provide electrical power to the actuator 228 and/or the pump 232 to extend and retract the arms 222. The power section 210 may be omitted from the centralizer 200, such as in implementations in which the hydraulic and/or electrical power is provided from the wellsite surface 104 via the conveyance means 120.

The mechanical control section 208 may be operable to control the mechanical power being transferred to the positioning section 206. For example, if the actuator 228 is powered by pressurized hydraulic fluid, the mechanical control section 208 may be or comprise one or more hydraulic valves 236 fluidly connected with the actuator 228 and operable to control direction, flow rate, and/or pressure of the hydraulic fluid being applied to the actuator 228 from the wellsite surface 104 or from the power section 210. The centralizer 200 may also comprise a pressure sensor 238 operable to output signals or information indicative of hydraulic fluid pressure generated by the hydraulic pump 232 or pressure of the hydraulic fluid being received by the actuator 228.

The electrical control section 212 may comprise a downhole controller 214 and other electronic components collectively operable to monitor and control the centralizer 200. The downhole controller 214 may be communicatively connected with the power section 210, the mechanical control section 208, and the positioning section 206 via the conductor 216. The downhole controller 214 may be communicatively connected with the surface controller 156 via the conductors 122, 216, such as may facilitate control of the centralizer 200 and/or other portions of the tool string 110 from the wellsite surface 104. Thus, the centralizer 200 and other portions of the tool string 110 may be automatically controlled by the surface and/or downhole controllers 156, 214 and/or manually controlled by a wellsite operator from the wellsite surface 104.

The surface and downhole controllers 156, 214 may each comprise a processing device (e.g., a computer) and a memory operable to store programs or instructions that, when executed by the processing device, may cause the centralizer 200, other portions of the tool string 110, and/or the surface equipment 140 to perform methods, processes, and/or routines described herein. The surface and/or the downhole controllers 156, 214 may each include various electronic components, such as an interface for receiving commands from the wellsite operator. The surface and/or downhole controllers 156, 214 may be operable to receive, store, and/or process operational set-points (e.g., signals, control commands) entered by wellsite operators and sensor measurements received from various sensors of the centralizer 200 and/or other portions of the tool string 110. The surface and/or downhole controllers 156, 214 may transmit control commands to various actuators of the centralizer 200, other portions of the tools string 110, and/or the surface equipment 140 to control such actuators based on the received operational set-points and sensor measurements. Thus, the surface and downhole controllers 156, 214 may operate independently or cooperatively to control the centralizer 200 and/or other portions of the tool string 110.

The surface and/or downhole controllers 156, 214 may be operable to control the various actuators of the power section 210, the mechanical control section 208, and/or the positioning section 206 based on entered (radial setting force) set-points (e.g., signals, control commands) indicative of the intended radial setting force and on sensor measurements facilitated by various sensors of the power section 210, the mechanical control section 208, and the positioning section 206 to cause the arms 222 to impart the intended radial setting force against the sidewall 103 of the wellbore 102. The surface and/or downhole controllers 156, 214 may be operable to control the radial setting force, for example, by controlling the force outputted by the actuator 228, such as by controlling the fluid and/or electrical power imparted to the actuator 228. The surface and/or downhole controllers 156, 214 may be further operable to cause the centralizer 200 to maintain the intended radial setting force at a substantially constant level while the tool string 110 is conveyed along the wellbore 102 and inner cross-sectional diameter of the wellbore 102 changes. The surface and/or downhole controllers 156, 214 may be further operable to cause the centralizer 200 to change the previously selected radial setting force to a new (e.g., different, higher, lower) intended radial setting force and then maintain the new intended radial setting force at a substantially constant level while the tool string 110 is conveyed along the wellbore 102 and inner cross-sectional diameter of the wellbore 102 changes.

Figure 3:
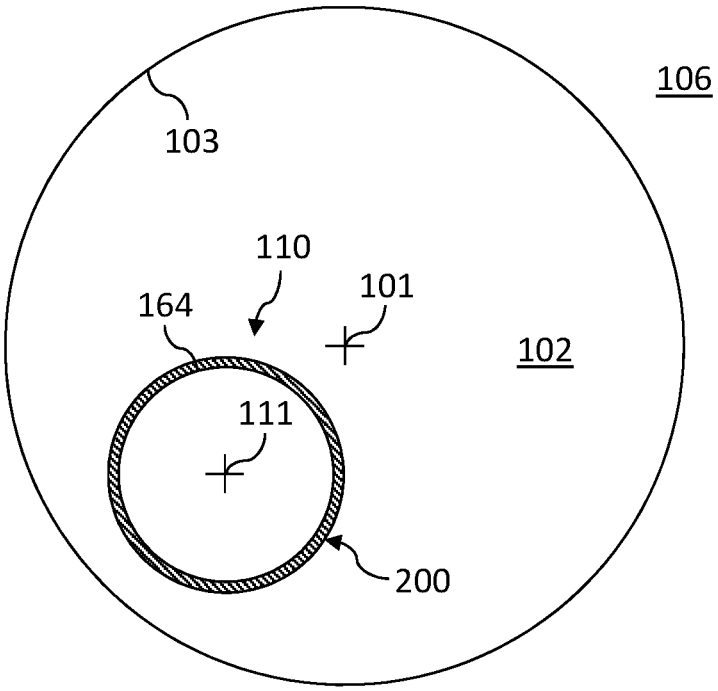
FIGS. 3 and 4 are axial sectional views of the apparatus shown in FIG. 2 at different stages of operation.
Figure 4:
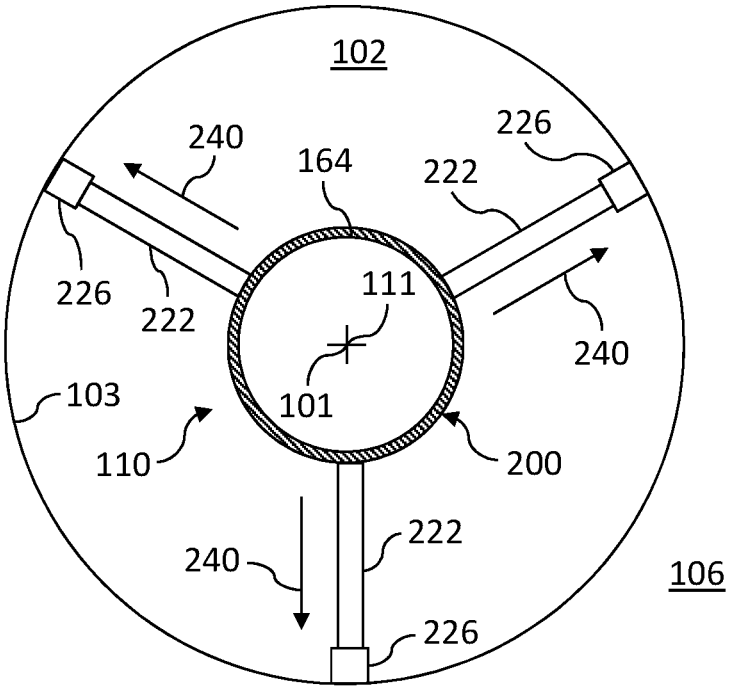

FIGS. 3 and 4 are axial sectional views of the tool string 110 shown in FIG. 2, at different stages of operation according to one or more aspects of the present disclosure. The following description refers to FIGS. 1-4, collectively.

FIG. 3 shows the tool string 110, including the centralizer 200 and the downhole tool 164, disposed within the wellbore 102 while not being substantially centered therein. The tool string 110, including the centralized 200 and the downhole tool 164, are shown laterally (i.e., radially) offset from the central axis 101 of the wellbore 102 such that the central axis 111 of the tool string 110 is eccentered or otherwise offset from and not substantially aligned with the central axis 101 of the wellbore 102. The centralizer 200 is shown with the arms 222 retracted, such that the arms 222 and the contact members 226 are encompassed within the cross sectional profile of the tool string 110 and, thus, hidden from view.

When it is intended to centralize an intended portion of the tool string 110, the centralizer 200 may be operated to extend the arms 222 against the sidewall 103, as indicated by arrows 240, to centralize the downhole tool 164 such that a portion of the central axis 111 extending through the intended portion of the tool string 110 is substantially aligned with or intercepts the central axis 101 of the wellbore 102. FIG. 4 shows the centralizer 200 with the arms 222 extended against the sidewall 103 of the wellbore 102, thereby centralizing the tool string 110, including the downhole tool 164, within the wellbore 102.

If just one centralizer 200 is operated and/or if the tool string 110 is positioned within a deviated portion of the wellbore 102, the entire tool string 110 may not be centralized, whereby the tool string 110 and its central axis 111 may extend diagonally within the wellbore 102 and with respect to the central axis 101. Thus, when it is intended to centralize the entire tool string 110, a plurality of centralizers 200 coupled along the tool string 110 may be operated to extend the corresponding arms 222 against the sidewall 103 to centralize the entire tool string 110, including the downhole tools 164, 166, such that the entire central axis 111 of the tool string 110 substantially coincides or is aligned with the central axis 101. FIG. 2 shows the tool string 110, including the centralizer 200 and the downhole tools 164, 166 disposed within the wellbore 102 while being substantially centered therein, such that the entire central axis 111 of the tool string 110 and the central axis 101 of the wellbore 102 are substantially aligned.

Figure 5:
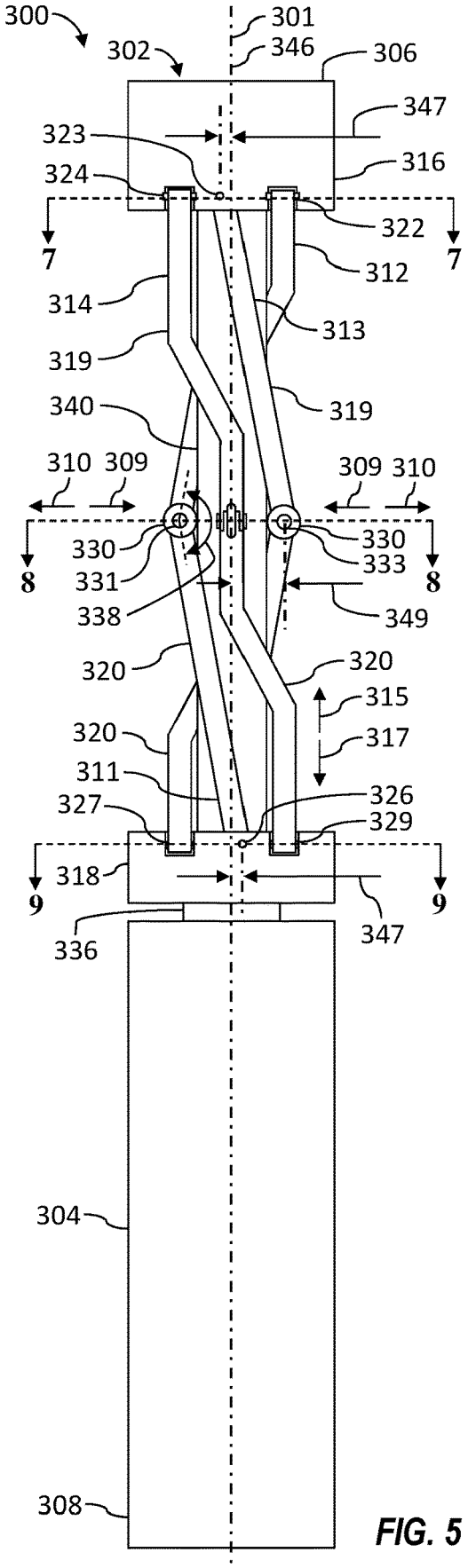
FIGS. 5 and 6 are side views of at least a portion of an example implementation of apparatus according to one or more aspects of the present disclosure at different stages of operation.
Figure 6:
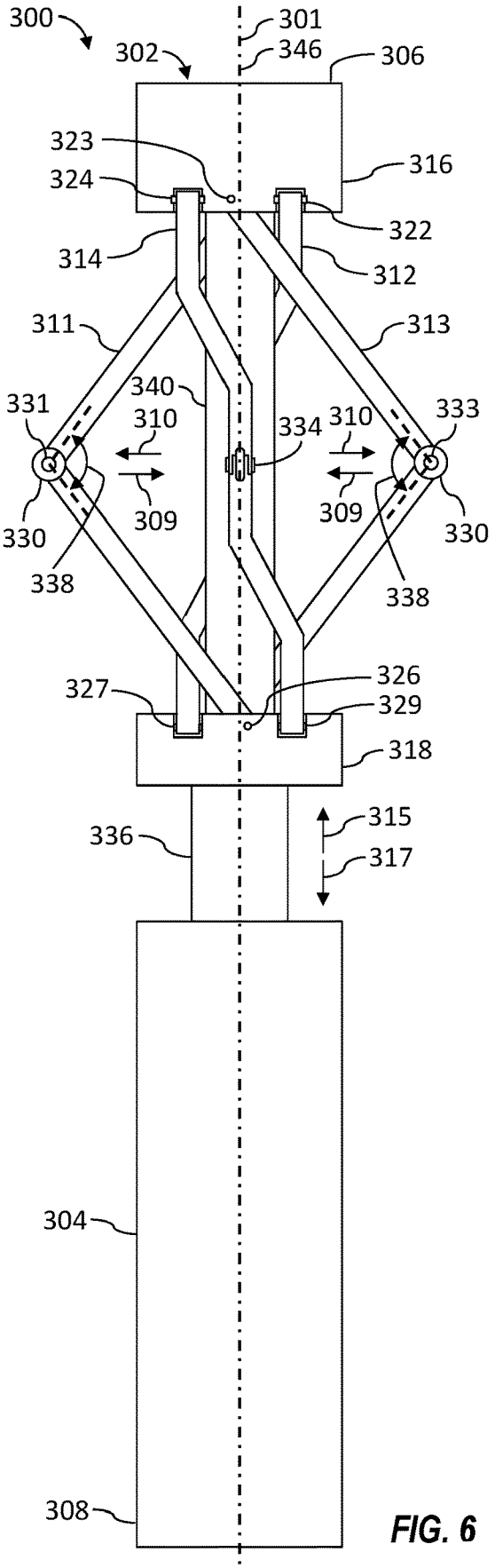

FIGS. 5 and 6 are schematic side views of at least a portion of an example implementation of a positioning section 302 of a centralizer 300 according to one or more aspects of the present disclosure at different stages of operation. The centralizer 300 may be operable to centralize at least a portion of a tool string within a wellbore and may comprise one or more features of the centralizers 170, 200 described above and shown in FIGS. 1-4, except as described below. The following description refers to FIGS. 1-6, collectively.

An upper end of the positioning section 302 may include an upper interface, a sub, a crossover, and/or another coupler 306 for mechanically and/or electrically coupling the centralizer 300 with a corresponding interface (not shown) of a downhole tool 164 or another portion of a tool string 110. A lower end of the positioning section 302 may include a lower interface, a sub, a crossover, and/or another coupler 308 for mechanically and/or electrically coupling the positioning section 302 with another section of the centralizer 300, such as the mechanical control section 208, the power section 210, or the electrical control section 212.

The positioning section 302 may further comprise a plurality of arms 311, 312, 313, 314 that, while the tool string 110 is conveyed along the wellbore 102, are operable to deploy or otherwise move into contact with a sidewall 103 of the wellbore 102 to centralize within the wellbore 102 at least a portion of the tool string 110, impart an intended (e.g., predetermined, selected, set) radial setting force against the sidewall 103 of the wellbore 102, and/or maintain the radial setting force substantially at the intended (constant) level while the tool string 110 is conveyed along the wellbore 102 and an inner cross-sectional diameter of the wellbore 102 changes. Each one of the arms 311-314 may be operable to move radially with respect to a central axis 301 of the centralizer 300, as indicated by arrows 309, 310, to centralize within the wellbore 102 at least a portion of the tool string 110 connected with the centralizer 300.

The arms 311-314 may be pivotably connected with opposing upper and lower carriers, mounting brackets, or other support members 316, 318 of the centralizer 300. Each arm 311-314 may comprise an upper arm member 319 and a lower arm member 320. Each upper arm member 319 may be pivotably connected with the upper support member 316 via, for example, a corresponding pivot joint 321 (obstructed from view), 322, 323, 324 (e.g., pivot pin disposed within a complementary bore) and each lower arm member 320 may be pivotably connected with the lower support member 318 via, for example, a corresponding pivot joint 326, 327, 328 (obstructed from view), 329. The upper and lower arm members 319, 320 of each arm 311-314 may be pivotably connected with each other, for example, via a corresponding pivot joint 331, 332 (obstructed from view), 333, 334. One or both of the support members 316, 318 may be selectively operable to move toward and away from each other to facilitate the radial movement 309, 310 of the arms 311-314. For example, the upper support member 316 may be static and the lower support member 318 may be axially movable along the central axis 301 toward and away from the upper support member 316, as indicated by arrows 315, 317, to cause corresponding radial movement of the arms 311-314, as indicated by the arrows 309, 310. A corresponding friction-reducing contact member 330 (e.g., a roller) may be operatively connected at each pivot joint 331-334, such as to reduce friction between the centralizer 300 and the sidewall 103 of the wellbore 102 or otherwise facilitate axial movement of the centralizer 300 along the wellbore 102, as described herein.

The positioning section 302 further comprises a body or housing 304 defining or otherwise encompassing a plurality of internal spaces or volumes containing various components of the positioning section 302. Although the housing 304 is shown as comprising a single unitary member, it is to be understood that the housing 304 may be or comprise a plurality of housing sections coupled together to form the housing 304. The housing 304 may encompass an actuator (not shown) operable to cause the lower support member 318 to move axially 315, 317.

The actuator may be or comprise, among other examples, a hydraulic piston, a hydraulic motor, an electric motor, or an electric linear actuator. The actuator and the lower support member 318 may be mechanically or otherwise operatively connected via a linking assembly or member, such as a shaft 336, extending at least partially between the actuator and the lower support member 318. The shaft 336 may be axially movable with respect to the housing 304 and operable to transfer axial force from the actuator to the lower support member 318.

The housing 304 and the upper support member 316 may be fixedly connected, such as to prevent or inhibit relative movement. For example, the housing 304 and the upper support member 316 may be connected via a rod, a shaft, or a mandrel 340. The mandrel 340 may extend through the lower support member 318, and the arms 311-314 may be distributed circumferentially about the mandrel 340. Because the housing 304 and mandrel 340 may be fixedly connected, the lower support member 318 may also be axially movable 315, 317 with respect to the mandrel 340. Thus, the axial movement 315, 317 of the lower support member 318 with respect to the mandrel 340 may cause the arms 311-314 to be moved radially toward 309 and away 310 from the mandrel 340 between a retracted position (shown in FIG. 5) in which the arms 311-314 are disposed against the mandrel 340 and an extended position (shown in FIG. 6) in which the arms 311-314 are disposed away from the mandrel 340 and against the sidewall 103 of the wellbore 102 when the centralizer 300 is conveyed within the wellbore 102 as part of a tool string 110.

Figure 7:
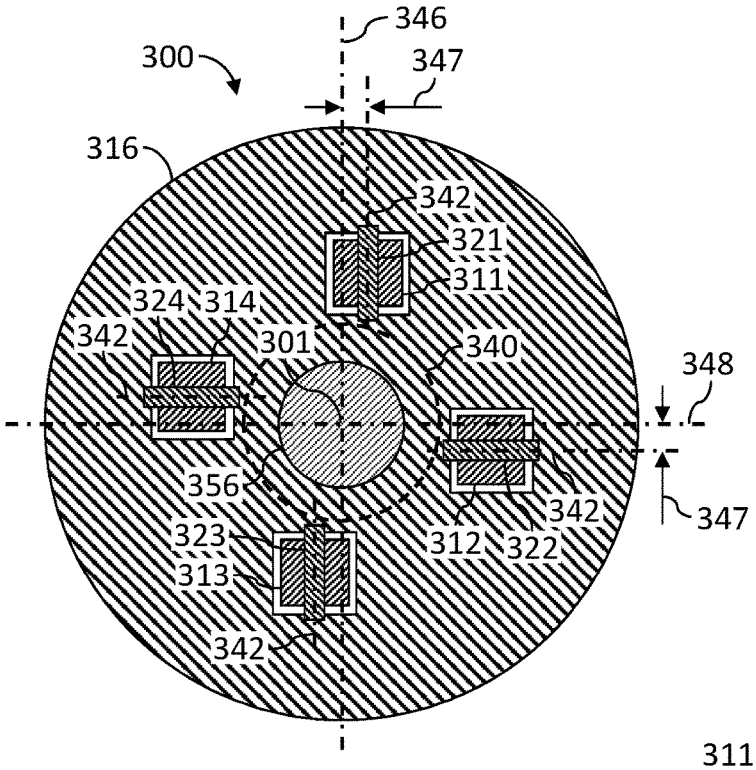
FIGS. 7-9 are axial sectional views of the apparatus shown in FIG. 5.
Figure 8:
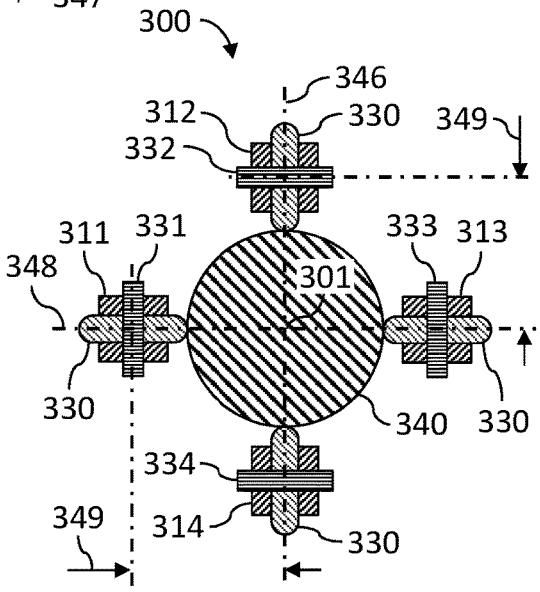
Figure 9:
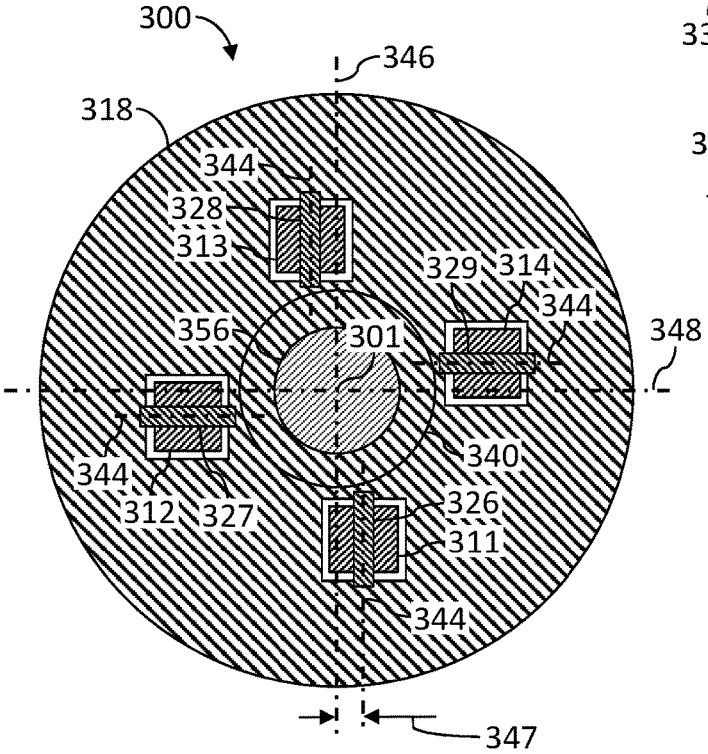

FIGS. 7, 8, and 9 are axial sectional views of different portions of the centralizer 300 shown in FIG. 5 according to one or more aspects of the present disclosure. FIG. 7 shows an axial sectional view of the upper support member 316, the upper pivot joints 321-324, and the upper arm members 319 of the arms 311-314, FIG. 8 shows an axial sectional view of the contact members 330, the intermediated pivot joints 331-334, and the arms 311-314, and FIG. 9 shows an axial sectional view of the lower support member 318, the lower pivot joints 326-329, and the lower arm members 320 of the arms 311-314. The following description refers to FIGS. 1-9, collectively.

The position and orientation of the pivot joints permit the upper and lower arm members 319, 320 of each arm 311-314 to be connected at an angle 338 that is appreciably lower than 180 degrees when the arms 311-314 are in the retracted position. Such angles 338 may reduce the axial force generated by the actuator sufficient to impart the intended radial setting force against the sidewall 103 of the wellbore 102 while the tool string 110 is conveyed within the wellbore 102.

The upper pivot joints 321-324 and lower pivot joints 326-329 of each arm 311-314 may each be located on one side of a plane 346, 348 coinciding with the central axis 301 of the centralizer 300 and the intermediate pivot joints 331-334 of each arm 311-314 may each be located on an opposing side of such plane 346, 348. The planes 346, 348 may intercept or extend perpendicularly with respect to each other. For example, as shown in FIGS. 7 and 9, the upper and lower pivot joints 321, 326 of the first arm 311, the upper and lower pivot joints 322, 327 of the second arm 312, the upper and lower pivot joints 323, 328 of the third arm 313, and the upper and lower pivot joints 324, 329 of the fourth arm 314 may each be located on the same side of a corresponding plane 346, 348. Such positioning of the pivot joints 321-324, 326-329, 331-334 may permit the angle 338 to be appreciably lower than 180 degrees when the arms 311-314 are in the retracted position.

As further shown in FIGS. 5-9, the upper and lower pivot joints 321, 326 of the first arm 311 may be located on one (i.e., same) side of the plane 346 offset by a distance 347 and the intermediate pivot joint 331 of the first arm 311 may be located on an opposing side of the plane 346 offset by a distance 349. The same configuration applies to the pivot joints 323, 328, 333 of the third arm 313. Similarly, the upper and lower pivot joints 322, 327 of the second arm 312 may be located on one side of the plane 348 offset by the distance 347 and the intermediate pivot joint 332 of the second arm 312 may be located on an opposing side of the plane 348 offset by the distance 349. The same configuration applies to the pivot joints 324, 329, 334 of the fourth arm 314.

The upper pivot joints 321-324 and lower pivot joints 326-329 of each arm 311-314 may be azimuthally distributed around the central axis 301 of the centralizer 300. However, each arm 311-314 may partially extend azimuthally around the mandrel 340 in a spiral manner, such that corresponding upper pivot joints 321-324 and lower pivot joints 326-329 of each arm 311-314 are azimuthally misaligned from each other about (i.e., around) or otherwise with respect to (e.g., on opposing sides of) the central axis 301. For example, the upper and lower pivot joints 321, 326 of the first arm 311 are located on opposing sides of the plane 348, the upper and lower pivot joints 322, 327 of the second arm 312 are located on opposing sides of the plane 346, the upper and lower pivot joints 323, 328 of the third arm 313 are located on opposing sides of the plane 348, and the upper and lower pivot joints 324, 329 of the fourth arm 314 are located on opposing sides of the plane 346. Furthermore, the upper pivot joints 321-324 and lower pivot joints 326-329 of each arm 311-314 are also shown asymmetrically disposed with respect to each other around the mandrel 340 and the central axis 301. Also, the upper pivot joints 321-324 and/or the lower pivot joints 326-329 may each be positioned or oriented such that axes of rotation 342 of the upper pivot joints 321-324 and/or axes of rotation 344 of the lower pivot joints 326-329 extend or project through the mandrel 340 extending between the upper and lower support members 316, 318.

Figure 10:
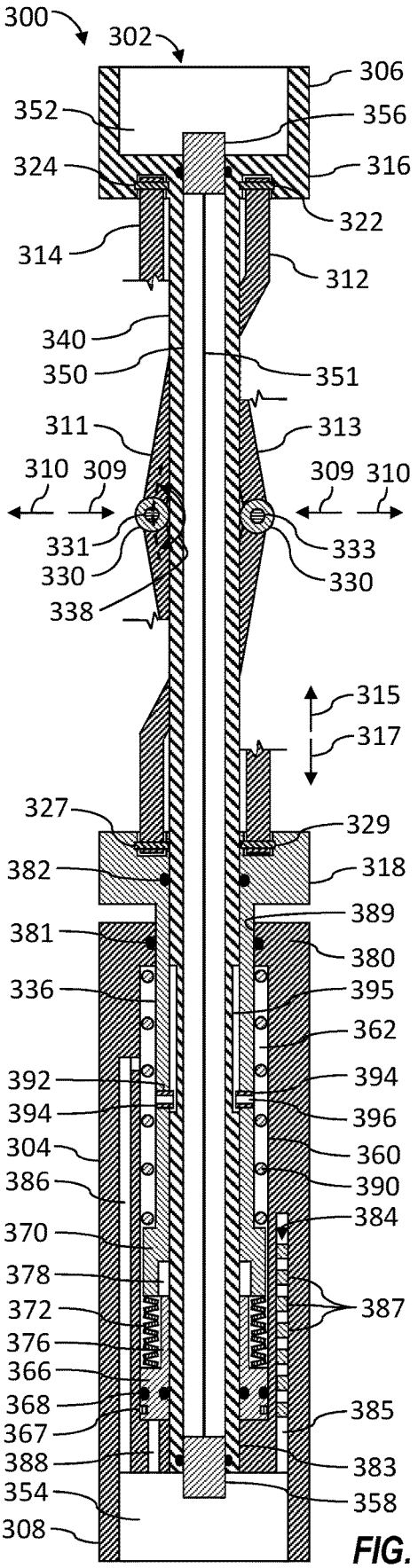
FIG. 10 is a side sectional view of the apparatus shown in FIG. 5.
Figure 11:
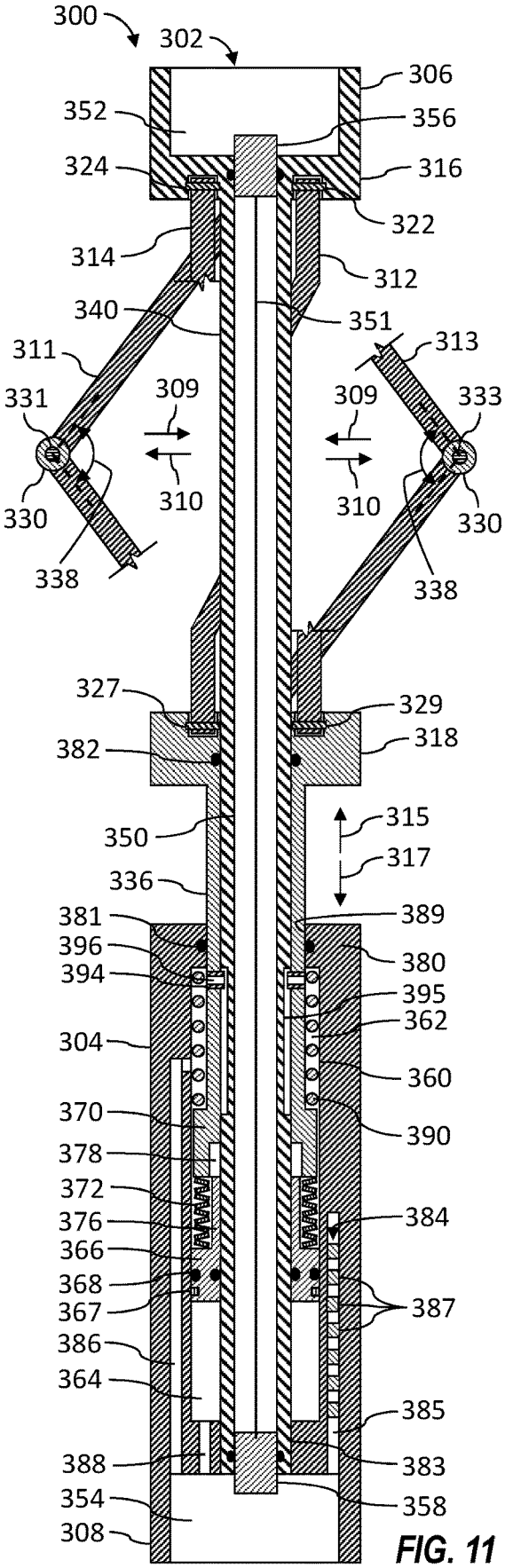
FIG. 11 is a side sectional view of the apparatus shown in FIG. 6.

FIGS. 10 and 11 are sectional side views of the positioning section 302 of the centralizer 300 shown in FIGS. 5 and 6, respectively. The following description refers to FIGS. 1-11, collectively.

The upper coupler 306 may comprise a mechanical interface, a sub, a crossover, and/or other means 352 for mechanically coupling the centralizer 300 with a corresponding mechanical interface (not shown) of the downhole tool 164 or another portion of the tool string 110. The interface means 352 may be integrally formed with or coupled to the upper support member 316, such as via a threaded connection. The lower coupler 308 may comprise a mechanical interface, a sub, a crossover, and/or other means 354 for mechanically coupling the positioning section 302 with a corresponding mechanical interface (not shown) of another section of the centralizer 300, such as the mechanical control section 208, the power section 210, or the electrical control section 212. The interface means 354 may be integrally formed with or coupled to the housing 304, such as via a threaded connection. The interface means 352, 354 may be or comprise threaded connectors, fasteners, box couplings, pin couplings, and/or other mechanical coupling means. Although the interface means 352, 354 are shown implemented as box connectors, one or both of the interface means 352, 354 may be implemented as pin connectors, for example.

The upper coupler 306 and/or another portion of an upper end of the positioning section 302 may further include an electrical interface, connector, and/or other means 356 for electrically coupling with a corresponding electrical interface (not shown) of the downhole tool 164 or another portion of the tool string 110. The lower coupler 308 and/or another portion of a lower end of the positioning section 302 may further include an electrical interface, connector, and/or other means 358 for electrically coupling with a corresponding electrical interface (not shown) of another section of the centralizer 300, such as the mechanical control section 208, the power section 210, or the electrical control section 212. The electrical coupling means 356, 358 may each comprise an electrical connector, plug, pin, receptacle, terminal, conduit box, and/or another electrical coupling means. An electrical conductor 351 may extend between the electrical coupling means 356, 358 through a longitudinal passage or bore 350 of the mandrel 340, such as may facilitate electrical connection and communication between the electrical coupling means 356, 358 and the devices connected therewith.

The actuator operable to generate a force operable to axially move the lower support member 318 with respect to the upper support member 316 may be implemented as a hydraulic piston assembly disposed within the housing 304. For example, the positioning section 302 may comprise an internal chamber 360 within the housing 304. The chamber 360 may accommodate or otherwise contain the mandrel 340 extending into the housing 304 thereby forming or otherwise defining an annular space or chamber extending between an inner surface of the housing 304 and the mandrel 340. A piston 366 (e.g., a hydraulic piston) may be movingly (e.g., slidably) disposed within the chamber 360, around the mandrel 340, and operatively connected with the lower support member 318 and, thus, operable to axially move the lower support member 318. The piston 366 may divide the chamber 360 into opposing upper and lower chamber volumes 362, 364. The piston 366 may slidably and sealingly engage an inner surface of the chamber 360 and an external surface of the mandrel 340 to fluidly separate the chamber volumes 362, 364. The piston 366 may carry fluid seals 368 (e.g., O-rings, cup seals, etc.) that may fluidly seal against the inner surface of the chamber 360 and the external surface of the mandrel 340 to prevent or inhibit fluids located on either side of the piston 366 from leaking between the chamber volumes 362, 364.

The chamber 360 may further contain another piston 370 (e.g., a compliance piston) or annular member movingly (e.g., slidably) disposed within the chamber 360, around the mandrel 340, and operatively connected with the piston 366. For example, a flexible member 372 may be disposed within the chamber 360 between the pistons 366, 370. The flexible member 372, such as a spring (e.g., coil spring, Belleville washers, etc.) or another biasing member, may facilitating transfer of axial force between the pistons 366, 370 while also permitting limited relative axial movement between the pistons 366, 370. For example, the piston 370 may be permitted to move axially downward a predetermined distance, as indicated by the arrow 317, while the piston 366 remains substantially static within the chamber 360. Similarly, the piston 366 may be permitted to move axially upward a predetermined distance, as indicated by the arrow 315, while the piston 370 remains substantially static within the chamber 360. An annular member 376 may support the flexible member 372 at a distance from the mandrel 340. The annular member 376 may be connected with or carried by one of the pistons 366, 370 and the other of the pistons 366, 370 may comprise a cavity 378 configured to receive at least a portion of the annular member 376 when the flexible member 372 is compressed between the pistons 366, 370, thereby permitting the pistons 366, 370 to move closer together or otherwise toward each other.

The shaft 336 may fixedly or otherwise operatively connect the piston 370 with the lower support member 318 such that the piston 370 and the support member 318 move substantially in unison. The shaft 336 may comprise a longitudinal (e.g., axial) bore configured to accommodate the mandrel 340 therethrough. The shaft 336 may be movingly (e.g., slidably) disposed over the mandrel 340 and extend through the chamber 360 and out of the housing 304. The shaft 336 may be axially movable within the chamber 360 and extend out of the housing 304 at an upper end of the housing 304. A stop section 380 of the housing 304 comprising an inner shoulder may retain the piston 370 within the chamber 360 and fluidly seal against the shaft 336 to prevent or inhibit fluid communication between the upper chamber volume 362 and the space external to the centralizer 300. The stop section 380 may comprise a central opening 389 to permit the shaft 336 to axially move out of the housing 304 and a fluid seal 381 to fluidly seal against the shaft 336 to prevent or inhibit fluid communication between the upper chamber volume 362 and the space external to the centralizer 300. Fluid seals 382 may be disposed between the support member 318 and the mandrel 340 to further prevent or inhibit fluid communication between the upper chamber volume 362 and the space external to the centralizer 300. The mandrel 340 and the housing 304 may be fixedly connected with each other at an interface 383 located below the shaft 336 and the pistons 366, 370, such as via threads, interference fit, complementary splines, and/or a plurality of bolts, among other examples.

A fluid port or passage 386 may extend through the housing 304 between the lower coupler 308 and the upper chamber volume 362, and a fluid port or passage 388 may extend between the coupler 308 and the lower chamber volume 364. Ends of fluid passages 386, 388 associated with the coupler 308 may be positioned such that the fluid passages 386, 388 become aligned with or otherwise fluidly connect with corresponding fluid passages (not shown) of the mechanical control section 208 or another portion of the centralizer 300 when the mechanical control section 208 or another portion of the centralizer 300 is coupled with the positioning section 302 via the coupler 308.

The centralizer 300 may further comprise a position sensor 384 operable to generate or otherwise output a signal or information indicative of axial position of one or both of the pistons 366, 370. The sensor 304 may be a contactless sensor, facilitating monitoring of the position of the pistons 366, 370 without physically contacting the pistons 366, 370. The sensor 384 may be disposed within a bore 385 extending longitudinally through a wall of the housing 304 adjacent or alongside at least a portion of the chamber 360 in a manner permitting sensing of the position of one or both of the pistons 366, 370 through the housing 304. The sensor 384 may be operable to detect distance or position of a magnet 367 (e.g., a magnetic ring) carried by or otherwise disposed in association with the piston 366. Thus, at least a portion of the housing 304 between the piston 366 and the sensor 304 may be or comprise non-magnetic metal (e.g., Monel, stainless steel) or other material. Although the magnet 367 is shown disposed in association with the piston 366, it is to be understood that the magnet 367 may instead be disposed in association with the piston 370. It is to be further understood that a corresponding magnet (e.g., the magnet 367) may instead be disposed in association with both of the pistons 366, 370. Accordingly, the position sensor 384 may be operable to generate or otherwise output a signal or information indicative of axial position of one or both of the pistons 366, 370.

The sensor 384 may be or comprise a plurality of Hall effect sensors 387 distributed or otherwise disposed alongside at least a portion of the chamber 360 within the bore 385 extending within the wall of the housing 304. Each Hall effect sensor 387 may be directed toward the chamber 360 and the piston 366. Each Hall effect sensor 387 may be operable to generate or otherwise output a signal or information (e.g., voltage) indicative of a distance from the magnet 367. The signals or information outputted by each Hall effect sensor 387 may be further indicative of axial position of the magnet 367 and, thus, of the piston 366 with respect to that Hall effect sensor 387. For example, the Hall effect sensors 387 may be distributed or arranged such that the sensing area or space of each Hall effect sensor 387 borders or overlaps with the sensing area or space of an adjacent Hall effect sensor 387. Thus, while the piston 366 moves axially along the chamber 360, the Hall effect sensors 387 may collectively output signals or information indicative of the position of the magnet 367 and, thus, of the piston 366.

The relationship between the position of the piston 366 and the signals outputted by the Hall effect sensors 387 may be calibrated, such as by associating incremental positions of the piston 366 with the signals or information outputted by the Hall effect sensors 387. During operations, while the piston 366 moves along the chamber 360, the signals or information outputted by each Hall effect sensor 387 may be analyzed to interpolate or otherwise determine the position of the magnet 367 and, thus, of the piston 366 based on the previously associated piston positions and outputted sensor signals.

The position of the piston 366 may be utilized to determine (e.g., calculate) axial position of the lower support member 318 and the radial position (i.e., lateral position, extension) of the arms 311-314, including the contact members 330. The position of the lower support member 318 can be utilized to determine the geometry (e.g., relative angles) of the arms 311-314, which is indicative of how an axial force imparted by the piston 366 is transferred to the arms 311-314 and the contact member 330 in the form of the radial setting force. For example, the axial force imparted by the piston 366 may be increased or reduced when transferred to the arms 311-314 based on the geometry and, thus, radial position of the arms 311-314. Accordingly, the position of the piston 366 may be utilized to determine the amount of axial force that is to be imparted by the piston 366 to cause the intended radial setting force to be imparted and maintained by the arms 311-314 against the sidewall 103 while the tool string 110 is conveyed along the wellbore 102 and an inner diameter of the wellbore 102 changes. As described herein, the force that is imparted by the piston 366 may be controlled by controlling hydraulic fluid pressure within the lower chamber volume 364.

During centralizing operations, the centralizer 300 may be operated to move the arms 311-314 radially away 310 from the central axis 301 and the mandrel 340, from a retracted position, shown in FIGS. 5 and 10, in which the arms 311-314 are disposed against the mandrel 340, to an extended position, shown in FIGS. 6 and 11, in which the arms 311-314 are disposed away from the mandrel 340 and against the sidewall 103 of the wellbore 102. The arms 311-314 may be extended, for example, by causing pressurized hydraulic fluid to be discharged from the power section 210 and directed by the mechanical control section 208 into the lower chamber volume 364 via the passage 388. Pressure of the hydraulic fluid may cause the piston 366 to move axially upward along the mandrel 340, as indicated by the arrow 315, thereby causing the flexible member 372 to contact and push the piston 370, the shaft 336, and the lower support member 318 in the axially upward direction 315 along the mandrel 340. The axially upward movement 315 of the lower pivot joints 326-329 may compress the arms 311-314, causing the arms 311-314 and the corresponding contact members 330 to move radially outward, as indicated by the arrows 310. While the piston 366 is being moved axially upward 315, pressure of the hydraulic fluid within the lower chamber volume 364 may be monitored via the pressure sensor 238 or another pressure sensor fluidly connected with the lower chamber volume 364 and/or the fluid passage 388.

When the contact members 330 contact the sidewall 103 of the wellbore 102, the arms 311-314, the shaft 336, and the pistons 366, 370 may stop moving and the pressure of the hydraulic fluid within the lower chamber volume 364 may increase. Such pressure may increase until an intended pressure is reached, resulting in the intended radial setting force being applied by the arms 311-314 to the sidewall 103 via the contact members 330. After the intended hydraulic fluid pressure is reached, the pressure of the hydraulic fluid applied to the lower chamber volume 364 may be maintained substantially constant, thereby maintaining the radial setting force against the sidewall 103 substantially constant.

The radial setting force applied to the sidewall 103 by the arms 311-314 may be related to an axial force that is applied by the piston 366 to the arms 311-314 (via the shaft 336) and depend at least partially on geometry (e.g., relative positions, lengths, angles, etc.) of the arms 311-314. For example, the radial setting force applied by the arms 311-314 may depend at least in part on the angle 338 between the upper and lower arm portions 319, 320. Hence, when the angle 338 decreases while the arms 311-314 are extending radially 310, an increasing portion of the axial force applied by piston 366 to the arms 311-314 may be transferred in the radially outward direction 310. When the angle 338 decreases below a certain level, the radial setting force may be amplified to exceed the axial upward force applied by the piston 366. Because the angle 338 depends at least in part on an axial position of the lower pivot joints 326-329 along the mandrel 340, the angle 338 and, thus, the radial setting force being applied by the arms 311-314 may depend on an axial position of the piston 366.

Thus, in order to apply an intended radial setting force to the sidewall 103 regardless of the radial position of the arms 311-314, the axial force applied by the piston 366 to the arms 311-314 may be changed based on the radial position of the arms 311-314, which is related to and can be determined based on the axial position of the piston 366. For example, when the centralizer 300 is disposed within a narrower inner diameter section 107 of the wellbore 102, the arms 311-314 may extend a lesser distance in the radially outward direction 310 and the piston 366 may be disposed a lesser distance (determined via the position sensor 384) in the axially upward direction 315. The geometry of the arms 311-314 (e.g., angle 338) in such position may result in a smaller portion of the axial force applied by the piston 366 to the arms 311-314 to be transferred in the radially outward direction 310. Accordingly, the pressure of the hydraulic fluid applied to the lower chamber volume 364 may be maintained at a higher level to facilitate the intended radial setting force. However, when the centralizer 300 is disposed within a wider inner diameter section 105 of the wellbore 102, the arms 311-314 may extend a greater distance in the radially outward direction 310 and the piston 366 may be disposed a greater distance in the axially upward direction 315. The geometry of the arms 311-314 (e.g., angle 338) in such position may result in a larger portion of the axial force applied by the piston 366 to the arms 311-314 to be transferred in the radially outward direction 310. Accordingly, the pressure of the hydraulic fluid applied to the lower chamber volume 364 may be maintained at a lower level to facilitate the intended radial setting force.

Furthermore, when the centralizer 300 is conveyed downhole through the wellbore 102 having a decreasing inner cross-sectional diameter (such as shown in FIG. 2), the arms 311-314 may be compressed in the radially inward direction 309 by the sidewall 103 of the wellbore 102, causing the piston 370 to move in the axially downward direction 317. The flexible member 372 may be compressed until the piston 370 contacts the piston 366. Upon contact with the piston 366, the piston 370 may suddenly slow down or stop, causing the arms 311-314 to also slow down or stop, resulting in the centralizer 300 experiencing a shock. Upon contact with the piston 366, the piston 370 may push the piston 366 in the axially downward direction 317. Such downward axial movement of the piston 366 may cause hydraulic fluid pressure within the lower chamber volume 364 to increase, thereby causing the hydraulic fluid to be relieved or otherwise transferred out of the lower chamber volume 364.

After the centralizer 300 enters the narrower diameter section 107 of the wellbore 102, a new axial position of the piston 366 may be detected by the sensor 384, causing the pressure of the hydraulic fluid applied to the lower chamber volume 364 to be maintained, increased, or otherwise changed based on the new axial position of the piston 366, such that the radial setting force applied to the sidewall 103 may be maintained substantially constant at the intended level. Accordingly, pressure of the hydraulic fluid within the lower chamber volume 364 applied to the piston 366 to maintain the radial setting force at a substantially constant level may be inversely (but not necessarily linearly) proportional to the cross-sectional diameter of the wellbore 102 through which the centralizer 300 is conveyed.

The flexible member 372 may permit the arms 311-314 to be compressed a predetermined radial distance in the radial inward direction 309 before the piston 370 contacts the piston 366, thereby reducing the shock associated with the pistons 366, 370 making contact. For example, the flexible member 372 may permit the arms 311-314 to be compressed in the radially inward direction 309 by small irregularities (e.g., debris, bumps, protrusions, welds, seams, etc.) along the sidewall 103 of the wellbore 102 without causing the piston 370 to contact the piston 366. The flexible member 372 may thus permit the arms 311-314 to be compressed in the radially inward direction 309 without changing position of the piston 366 and, thus, without changing the volume of hydraulic fluid within the lower chamber volume 364 or the pressure of hydraulic fluid applied to the lower chamber volume 364. As described herein, the surface and/or downhole controllers 156, 214 may be operable to receive sensor signals or information from the pressure and/or position sensors 238, 384 and transmit control signals to the pump 232 and/or the hydraulic valves 236 to control the hydraulic fluid pressure within the passage 388 and the chamber volume 364, and, thus, the radial setting force, based on the received sensor signals or information.

When it is intended to move the arms 311-314 to the retracted position, as shown in FIGS. 5 and 10, the pressurized hydraulic fluid may be discharged from the power section 210 and directed into the upper chamber volume 362 via the passage 386 by the mechanical control section 208, and the hydraulic fluid within the lower chamber volume 364 may be permitted to be discharged therefrom via the passage 388. Pressure of the hydraulic fluid within the upper chamber volume 362 may cause the piston 370 and/or the piston 366 to move axially downward, as indicated by the arrow 317, forcing the hydraulic fluid within the lower chamber volume 364 to be discharged via the passage 388. The pistons 366, 370 may also or instead be moved axially downward 317 by a biasing member 390 (e.g., a coil spring) disposed within the upper chamber volume 362 against the piston 370. The biasing member 390 may bias the piston 370 in the axially downward direction 317, such as may facilitate movement of the pistons 366, 370 in the axially downward direction 317 when the hydraulic pressure within the lower chamber volume 364 is relieved or otherwise sufficiently reduced to permit the biasing member 390 to move the pistons 366, 370. The pistons 366, 370 may be moved in the axially downward direction 317 until the piston 366 reaches a lower end of the chamber 360.

During operations, the hydraulic fluid transferred into the upper chamber volume 362 may be in communication with an annular space or gap formed between the shaft 336 and the mandrel 340 via one or more ports 392 extending through the shaft 336. Hydraulic fluid within such space or gap may reduce friction between the shaft 336 and the mandrel 340 while the shaft 336 moves axially 315, 317 along the mandrel 340. The ports 392 may contain therein locator pins 394 extending into corresponding channels 395 extending longitudinally (e.g., axially) along the external surface of the mandrel 340. During operations of the centralizer 300, each locator pin 394 may slidably move within or otherwise engage a corresponding channel 395, preventing or inhibiting rotational movement of the shaft 336 and the lower support member 318 with respect to the mandrel 340 and the housing 304. Each pin 394 may comprise a fluid passage 396 extending therethrough, permitting the hydraulic fluid within the upper chamber volume 362 to be in communication with the annular space or gap between the shaft 336 and the mandrel 340.

The radial setting force applied by the centralizer 300 may be set (e.g., implemented, programmed, calibrated) while the centralizer 300 is at the wellsite surface 104. The radial setting force applied by the centralizer 300 may be set while the centralizer 300 is conveyed within the wellbore 102 from the wellsite surface 104 via the electrical conductors 122, 216, 351. The radial setting force applied by the centralizer 300 may be changed while the centralizer 300 is conveyed within the wellbore 102 from the wellsite surface 104 via the electrical conductors 122, 216, 351.

The radial setting force applied by the centralizer 300 may be set while the centralizer 300 is at the wellsite surface 104 by calibrating the positioning section 206, 302, the mechanical control section 208, and/or the power section 210. For example, the centralizer 300 may be calibrated to impart an intended radial setting force by (e.g., mechanically) calibrating the hydraulic pump 232 and/or the hydraulic valves 236 to facilitate an intended pressure of the hydraulic fluid within the lower chamber volume 364 causing the arms 311-314 to apply the intended radial setting force.

The radial setting force applied by the centralizer 300 may be set while the centralizer 300 is at the wellsite surface 104 and/or while the centralizer 300 is conveyed within the wellbore 102 via the surface and/or downhole controllers 156, 214. For example, the surface and/or downhole controllers 156, 214 may be operable to control the radial setting force based on (radial setting force) set-points (e.g., signals, control commands) indicative of an intended radial setting force received by one or both of the controllers 156, 214. The surface and/or downhole controllers 156, 214 may be operable to control the radial setting force, for example, by controlling the axial force imparted to the arms 311-314 by the piston 366, such as by controlling the hydraulic pump 232 and/or the hydraulic valves 236 to control pressure of the hydraulic fluid within the lower chamber volume 364. The surface and/or downhole controllers 156, 214 may be further operable to cause the centralizer 300 to maintain the intended radial setting force at a substantially constant level while the centralizer 300 is conveyed along the wellbore 102 and the inner cross-sectional diameter of the wellbore 102 changes.

The surface and/or downhole controllers 156, 214 may be further operable to receive new set-points indicative of a new (e.g., different, higher, lower) intended radial setting force while the centralizer 300 is conveyed within the wellbore 102. Based on the new set-points, the surface and/or downhole controllers 156, 214 may then cause the centralizer 300 to change the radial setting force from the previously selected radial setting force to the new intended radial setting force and then maintain the new intended radial setting force at a substantially constant level while the centralizer 300 is conveyed along the wellbore 102 as part of the tool string 110 and the inner cross-sectional diameter of the wellbore 102 changes.

Certain features of the centralizers 200, 300 are described herein using relative directional terms, including "upward", "upper", "downward", and "lower". However, it is to be understood that such terms describe features as shown in the corresponding figures. The directional terms may describe certain features with respect to a wellbore through which the centralizers 170, 200, 300 are conveyed, wherein the terms upward and upper may mean in an uphole direction or uphole from, and the terms downward and lower may mean in a downhole direction or downhole from. However, it is to be understood that the centralizers 170, 200, 300 and/or certain features thereof may be directed or oriented differently than as shown in the corresponding figures without affecting their operation. For example, orientation or direction of the centralizers 200, 300 and/or the corresponding positioning sections 206, 302 may be reversed, such that features described as being upper and/or moving upward, may in fact be lower (i.e., downhole) features and/or moving downwardly (i.e., in a downhole direction) with respect to a wellbore, and features described as being lower and/or moving downward, may in fact be upper (i.e., uphole) features and/or moving upwardly (i.e., in an uphole direction) with respect to the wellbore.

The operations, processes, and/or methods described herein may be performed utilizing or otherwise in conjunction with at least a portion of one or more implementations of one or more instances of the apparatus shown in one or more of FIGS. 1-11 and/or otherwise within the scope of the present disclosure. However, the operations, processes, and/or methods described herein may be performed in conjunction with implementations of apparatus other than those depicted in FIGS. 1-11 that are also within the scope of the present disclosure. The operations, processes, and/or methods described herein may be performed manually by one or more wellsite operators and/or performed or caused to be performed, at least partially, by the surface controller 156, the downhole controller 214, and/or another processing device executing coded instructions according to one or more aspects of the present disclosure. For example, the controllers 156, 214 and/or the processing device may receive input signals and automatically generate an output signal to operate or cause a change in an operational parameter of one or more pieces of the wellsite equipment described above. However, the wellsite operator may also or instead manually operate the one or more pieces of wellsite equipment based on the sensor signals.

Figure 12:
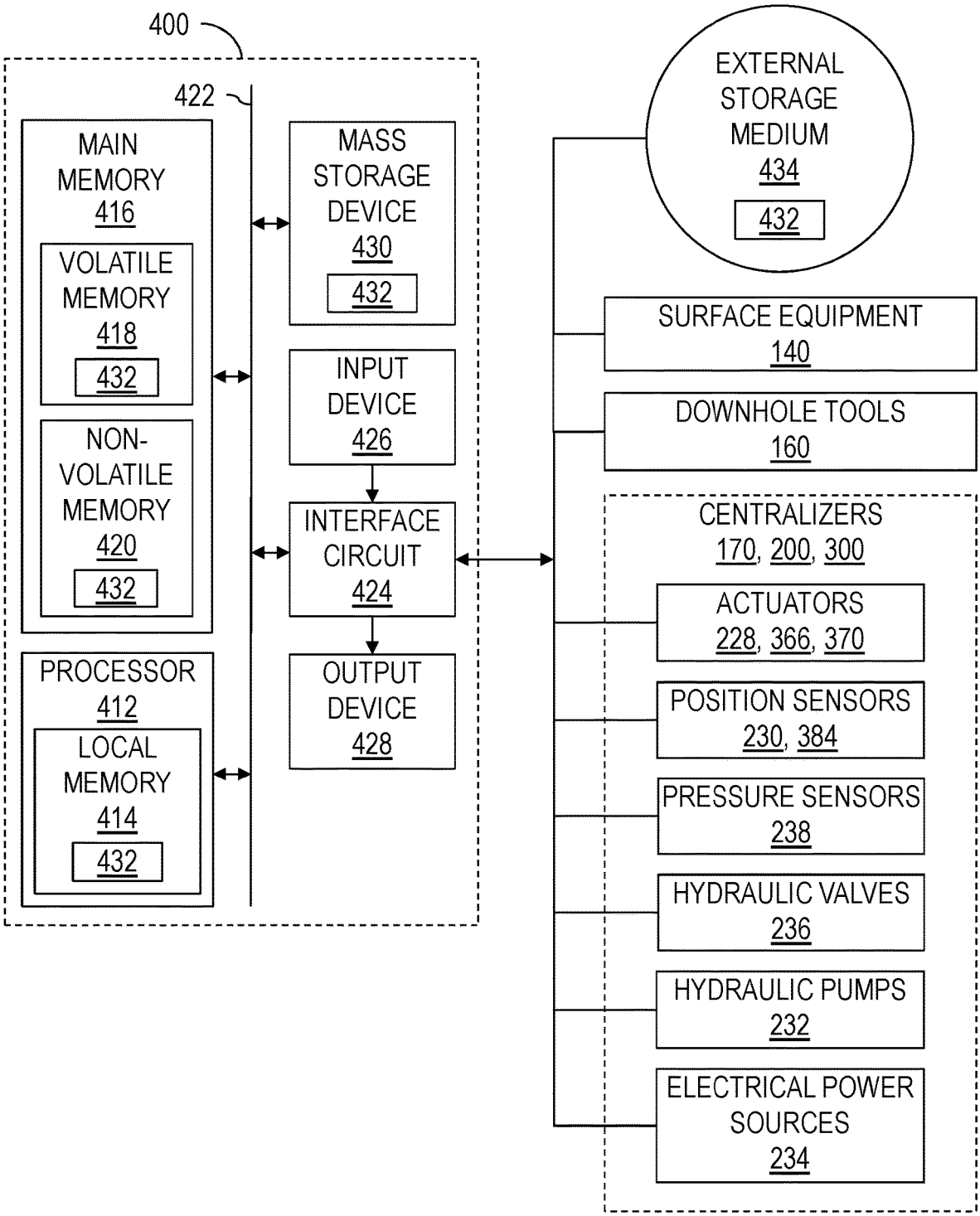
FIG. 12 is a schematic view of at least a portion of an example implementation of apparatus according to one or more aspects of the present disclosure.

FIG. 12 is a schematic view of at least a portion of an example implementation of a processing device 400 according to one or more aspects of the present disclosure. The processing device 400 may be in communication with the surface equipment 140, including the tensioning device 130 and the power and control system 150. The processing device 400 may be in communication with the various tools 160 and centralizers 170, 200, 300 of the tool string 110. The processing device 400 may be in communication with the positioning section 206, the mechanical control section 208, the power section 210, and the electrical control section 212 of the centralizer 200. For example, the processing device 400 may be in communication with the actuator 228, the position sensor 230, 384, the pressure sensor 238, the hydraulic valve 236, the hydraulic pump 232, and/or the electrical power source 234. For clarity, these and other components in communication with the processing device 400 will be collectively referred to hereinafter as "sensor and controlled equipment." Accordingly, the following description refers to FIGS. 1-12, collectively.

The processing device 400 may be operable to receive coded instructions 432 from the wellsite operators and signals generated by the sensor equipment, process the coded instructions 432 and the signals, and communicate control signals to the controlled equipment to execute the coded instructions 432 to implement at least a portion of one or more example methods and/or operations described herein, and/or to implement at least a portion of one or more of the example systems described herein. The processing device 400 may be or form a portion of the surface controller 156 and/or the downhole controller 214.

The processing device 400 may be or comprise, for example, one or more processors, special-purpose computing devices, servers, personal computers (e.g., desktop, laptop, and/or tablet computers) personal digital assistant (PDA) devices, smartphones, internet appliances, and/or other types of computing devices. The processing device 400 may comprise a processor 412, such as a general-purpose programmable processor. The processor 412 may comprise a local memory 414, and may execute coded instructions 432 present in the local memory 414 and/or another memory device. The processor 412 may execute, among other things, the machine-readable coded instructions 432 and/or other instructions and/or programs to implement the example methods and/or operations described herein. The programs stored in the local memory 414 may include program instructions or computer program code that, when executed by an associated processor, facilitate the wellsite system 100, the tool string 110, and/or the centralizers 170, 200, 300 to perform the example methods and/or operations described herein. The processor 412 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Of course, other processors from other families are also appropriate.

The processor 412 may be in communication with a main memory 416, such as may include a volatile memory 418 and a non-volatile memory 420, perhaps via a bus 422 and/or other communication means. The volatile memory 418 may be, comprise, or be implemented by random-access memory (RAM), static RAM (SRAM), dynamic RAM (DRAM), synchronous DRAM (SDRAM), RAMBUS DRAM (RDRAM), and/or other types of RAM devices. The non-volatile memory 420 may be, comprise, or be implemented by read-only memory, flash memory, and/or other types of memory devices. One or more memory controllers (not shown) may control access to the volatile memory 418 and/or non-volatile memory 420.

The processing device 400 may also comprise an interface circuit 424. The interface circuit 424 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 424 may also comprise a graphics driver card. The interface circuit 424 may also comprise a communication device, such as a modem or network interface card to facilitate exchange of data with external computing devices via a network (e.g., Ethernet connection, digital subscriber line (DSL), telephone line, coaxial cable, cellular telephone system, satellite, etc.). One or more of the controlled equipment may be connected with the processing device 400 via the interface circuit 424, such as may facilitate communication between the controlled equipment and the processing device 400.

One or more input devices 426 may also be connected to the interface circuit 424. The input devices 426 may permit the wellsite operators to enter the coded instructions 432, such as control commands, processing routines, and input data, such as set-points indicative of intended radial setting force. The input devices 426 may be, comprise, or be implemented by a keyboard, a mouse, a touchscreen, a track-pad, a trackball, an isopoint, and/or a voice recognition system, among other examples. One or more output devices 428 may also be connected to the interface circuit 424. The output devices 428 may be, comprise, or be implemented by display devices (e.g., a liquid crystal display (LCD), a light-emitting diode (LED) display, or cathode ray tube (CRT) display), printers, and/or speakers, among other examples. The processing device 400 may also communicate with one or more mass storage devices 430 and/or a removable storage medium 434, such as may be or include floppy disk drives, hard drive disks, compact disk (CD) drives, digital versatile disk (DVD) drives, and/or USB and/or other flash drives, among other examples.

The coded instructions 432 may be stored in the mass storage device 430, the main memory 416, the local memory 414, and/or the removable storage medium 434. Thus, the processing device 400 may be implemented in accordance with hardware (perhaps implemented in one or more chips including an integrated circuit, such as an ASIC), or may be implemented as software or firmware for execution by the processor 412. In the case of firmware or software, the implementation may be provided as a computer program product including a non-transitory, computer-readable medium or storage structure embodying computer program code (i.e., software or firmware) thereon for execution by the processor 412. The coded instructions 432 may include program instructions or computer program code that, when executed by the processor 412, may cause the wellsite system 100, the tool string 110, and/or the centralizers 170, 200, 300 to perform intended methods, processes, and/or operations disclosed herein.

In view of the entirety of the present disclosure, including the figures and the claims, a person having ordinary skill in the art will readily recognize that the present disclosure introduces an apparatus comprising a downhole tool operable to be coupled with a tool string and conveyed within a downhole passage, wherein the downhole passage is a wellbore or a tubular member disposed in the wellbore, and wherein the downhole tool comprises a plurality of arms that are operable to: move against a sidewall of the downhole passage to centralize at least a portion of the tool string within the downhole passage; impart an intended force against the sidewall of the downhole passage; and maintain the intended force substantially constant while the tool string is conveyed along the downhole passage and an inner diameter of the downhole passage changes.

The downhole tool may be a first of a plurality of downhole tools, and the plurality of downhole tools may be collectively operable to centralize the tool string within the downhole passage.

Each one of the arms may be operable to move radially with respect to a central axis of the downhole tool to move the at least a portion of the tool string substantially perpendicularly with respect to a central axis of the downhole passage to centralize within the downhole passage the at least a portion of the tool string.

Each arm may comprise a roller for contacting the sidewall of the downhole passage.

The downhole tool may comprise a static support member and a movable support member, each of the arms may comprise a first arm member pivotably connected with the static support member and a second arm member pivotably connected with the movable support member, and the movable support member may be operable to move axially to facilitate movement of the arms against the sidewall of the downhole passage.

The downhole tool may comprise a first support member and a second support member, each of the arms may comprise a first arm member pivotably connected with the first support member via a first pivot joint and a second arm member pivotably connected with the second support member via a second pivot joint, and for each of the arms the first and second pivot joints may be azimuthally misaligned around a central axis of the downhole tool.

The downhole tool may comprise a first support member and a second support member, each of the arms may comprise a first arm member pivotably connected with the first support member via a first pivot joint and a second arm member pivotably connected with the second support member via a second pivot joint, and for each of the arms the first pivot joint may be located on a first side of a plane coinciding with a central axis of the downhole tool and the second pivot joint may be located on a second side of the plane coinciding with the central axis of the downhole tool opposite the first side.

The downhole tool may comprise a first support member and a second support member, each of the arms may comprise a first arm member pivotably connected with the first support member via a first pivot joint and a second arm member pivotably connected with the second support member via a second pivot joint, the first and second arm members may be pivotably connected via a third pivot joint, and for each of the arms the first and second pivot joints may be located on a first side of a plane coinciding with a central axis of the downhole tool and the third pivot joint may be located on a second side of the plane coinciding with the central axis of the downhole tool opposite the first side.

The downhole tool may comprise a static support member and a movable support member, each of the arms may be pivotably connected with the static and movable support members, the intended force may be an intended radial force, and the movable support member may be operable to: move axially to facilitate movement of the arms against the sidewall of the downhole passage; and apply a changing axial force to the arms to maintain the intended radial force substantially constant while the tool string is conveyed along the downhole passage and the inner diameter of the downhole passage changes. The changing axial force applied to the arms by the movable support member may change based on: axial position of the movable member; and/or radial position of the arms. The downhole tool may further comprise a housing and a piston slidably disposed within the housing, the piston may be operatively connected with the movable support member, and the housing may be configured to receive hydraulic fluid thereby causing: the piston and movable support member to move axially; and the arms to move radially against the sidewall of the downhole passage.

The downhole tool may comprise a housing, a chamber within the housing, and a piston slidably disposed within the chamber and dividing the chamber into a first chamber volume and a second chamber volume, wherein the piston may be operatively connected with the arms, and wherein the first chamber volume may be configured to receive hydraulic fluid thereby causing the piston to move axially within the chamber and the arms to move radially against the sidewall of the downhole passage.

The downhole tool may comprise a piston operatively connected with the arms, and the piston may be operable to move via hydraulic fluid to cause the arms to move against the sidewall of the downhole passage. The downhole tool may further comprise a pressure sensor operable to output a signal or information indicative of pressure of the hydraulic fluid, and the downhole tool may be further operable to change the pressure of the hydraulic fluid to maintain the intended force substantially constant while the tool string is conveyed along the downhole passage and the inner diameter of the downhole passage changes. The downhole tool may further comprise a position sensor operable to output signals or information indicative of position of the piston and thus the arms, and the downhole tool may be further operable to change pressure of the hydraulic fluid based on the signals or information to maintain the intended force substantially constant while the tool string is conveyed along the downhole passage and the inner diameter of the downhole passage changes. The downhole tool may further comprise a hydraulic pump operable to pressurize the hydraulic fluid and a hydraulic fluid control valve fluidly connected with the hydraulic pump, wherein the hydraulic pump and/or the hydraulic fluid control valve may be operable to change pressure of the hydraulic fluid to maintain the intended force substantially constant while the tool string is conveyed along the downhole passage and the inner diameter of the downhole passage changes. The piston may be a first piston, the downhole tool may comprise a second piston operatively connected with the arms, and the first and second pistons may be operatively connected with each other via a flexible member. The flexible member may be or comprise a spring. The piston and the arms may be mechanically connected via at least a shaft, the piston and the shaft may be slidably disposed about a mandrel, and the arms may be radially movable with respect to the mandrel. The mandrel may comprise a bore extending longitudinally therethrough.

The downhole tool may be operable to receive from a wellsite surface a force set-point signal indicative of the intended force while the downhole tool is coupled with the tool string and conveyed within the downhole passage thereby causing the arms to: impart the intended force against the sidewall of the downhole passage; and maintain the intended force substantially constant while the tool string is conveyed along the downhole passage and the inner diameter of the downhole passage changes. The force set-point signal may be a first force set-point signal, the intended force may be a first intended force, and the downhole tool may be further operable to receive from the wellsite surface a second force set-point signal indicative of a second intended force while the downhole tool is coupled with the tool string and conveyed within the downhole passage thereby causing the arms to: impart the second intended force against the sidewall of the downhole passage; and maintain the second intended force substantially constant while the tool string is conveyed along the downhole passage and the inner diameter of the downhole passage changes.

The present disclosure also introduces an apparatus comprising a downhole tool operable to be coupled with a tool string and conveyed within a downhole passage, wherein: the downhole passage is a wellbore or a tubular member disposed in the wellbore; the downhole tool comprises a first support member, a second support member, and a plurality of arms; and each of the arms comprises a first arm member pivotably connected with the first support member via a first pivot joint and a second arm member pivotably connected with the second support member via a second pivot joint. For each of the arms, the first and second pivot joints are offset from and located on the same side of a plane coinciding with a central axis of the downhole tool.

Each one of the arms may be operable to move radially with respect to a central axis of the downhole tool to move the at least a portion of the tool string substantially perpendicularly with respect to a central axis of the downhole passage to centralize within the downhole passage the at least a portion of the tool string.

Each arm may comprise a roller for contacting the sidewall of the downhole passage.

The second support member may be operable to move axially to facilitate movement of the arms against the sidewall of the downhole passage.

Each of the arms may comprise a third pivot joint offset from and located on a side of the plane opposite from the side on which the first and second pivot joints are located.

The first and second arm members may be pivotably connected via a third pivot joint offset from and located on a side of the plane opposite from the side on which the first and second pivot joints are located.

For each of the arms, the first and second pivot joints may be azimuthally misaligned around a central axis of the downhole tool.

The plane may be a first plane and, for each of the arms: the first pivot joint may be located on a first side of a second plane coinciding with the central axis of the downhole tool; and the second pivot joint may be located on a second side of the second plane opposite the first side of the second plane, wherein the first and second planes may extend substantially perpendicularly with respect to each other.

The arms may be operable to: move against a sidewall of the downhole passage to centralize at least a portion of the tool string within the downhole passage; impart an intended force against the sidewall of the downhole passage; and maintain the intended force substantially constant while the tool string is conveyed along the downhole passage and an inner diameter of the downhole passage changes. The intended force may be an intended radial force, and the second support member may be operable to: move axially to facilitate movement of the arms against the sidewall of the downhole passage; and apply a changing axial force to the arms to maintain the intended radial force substantially constant while the tool string is conveyed along the downhole passage and the inner diameter of the downhole passage changes. The changing axial force applied to the arms by the movable support member may change based on axial position of the movable member and/or radial position of the arms.

The downhole tool may further comprise a housing and a piston slidably disposed within the housing, the piston may be operatively connected with the second support member, and the housing may be configured to receive hydraulic fluid thereby causing: the piston and movable second support member to move axially; and the arms to move radially against the sidewall of the downhole passage.

The present disclosure also introduces an apparatus comprising a downhole tool operable to be coupled with a tool string and conveyed within a downhole passage, wherein the downhole passage is a wellbore or a tubular member disposed in the wellbore, and wherein the downhole tool comprises: a plurality of arms; and a piston operatively connected with the arms, wherein the piston is operable to cause the arms to move against the sidewall of the downhole passage to centralize at least a portion of the tool string within the downhole passage when the piston is moved by hydraulic fluid.

The piston may be further operable to cause the arms to: impart an intended radial force against the sidewall of the downhole passage; and maintain the intended radial force substantially constant while the tool string is conveyed along the downhole passage and an inner diameter of the downhole passage changes. The piston may be further operable to apply a changing axial force to the arms to maintain the intended radial force substantially constant while the tool string is conveyed along the downhole passage and the inner diameter of the downhole passage changes. The changing axial force applied to the arms by the piston may change based on axial position of the piston and/or radial position of the arms. The downhole tool may further comprise a static support member and a movable support member operatively connected with the piston, each of the arms may comprise a first arm member pivotably connected with the static support member and a second arm member pivotably connected with the movable support member, and the piston may be further operable to apply a changing axial force to the movable support member to maintain the intended radial force substantially constant while the tool string is conveyed along the downhole passage and the inner diameter of the downhole passage changes. The downhole tool may further comprise a pressure sensor operable to output a signal or information indicative of pressure of the hydraulic fluid, and the downhole tool may be further operable to change the pressure of the hydraulic fluid to maintain the intended radial force substantially constant while the tool string is conveyed along the downhole passage and the inner diameter of the downhole passage changes. The downhole tool may further comprise a position sensor operable to output signals or information indicative of position of the piston and thus of the arms, and the downhole tool may be further operable to change pressure of the hydraulic fluid based on the signals or information to maintain the intended radial force substantially constant while the tool string is conveyed along the downhole passage and the inner diameter of the downhole passage changes. The downhole tool may further comprise a hydraulic pump operable to pressurize the hydraulic fluid and a hydraulic fluid control valve fluidly connected with the hydraulic pump, wherein the hydraulic pump and/or the hydraulic fluid control valve may be operable to change pressure of the hydraulic fluid to maintain the intended radial force substantially constant while the tool string is conveyed along the downhole passage and the inner diameter of the downhole passage changes.

The downhole tool may further comprise a housing, the piston may be slidably disposed within the housing, and the housing may be configured to receive the hydraulic fluid thereby causing the piston to move axially and the arms to move radially against the sidewall of the downhole passage.

The downhole tool may further comprise a housing and a chamber within the housing, the piston may be slidably disposed within the chamber and divide the chamber into a first chamber volume and a second chamber volume, and the first chamber volume may be configured to receive the hydraulic fluid thereby causing the piston to move axially within the chamber and the arms to move radially against the sidewall of the downhole passage.

The downhole tool may further comprise a plurality of Hall effect sensors disposed adjacent to the piston and collectively operable to output signals or information indicative of position of the piston.

The downhole tool may further comprise a housing and a chamber within the housing, the piston may be slidably disposed within the chamber, and the Hall effect sensors may be distributed alongside the chamber within a wall of the housing.

The piston may be a first piston, the downhole tool may further comprise a second piston operatively connected with the arms, and the first and second pistons may be operatively connected with each other via a flexible member. The flexible member may be or comprise a spring.

The piston and the arms may be mechanically connected via at least a shaft, the piston and the shaft may be slidably disposed about a mandrel, and the arms may be radially movable with respect to the mandrel. The mandrel may comprise a bore extending longitudinally therethrough.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a downhole tool operable to be coupled with a tool string and conveyed within a downhole passage, wherein the downhole passage is a wellbore or a tubular member disposed in the wellbore, and wherein the downhole tool comprises:

a first support member;

a second support member; and a plurality of arms, wherein each arm comprises:

a first arm member pivotably connected with the first support member via a first pivot joint;

a second arm member pivotably connected with the second support member via a second pivot joint, wherein for each arm the first and second pivot joints are offset from a plane coinciding with a central axis of the downhole tool, wherein for each arm the first and second pivot joints are azimuthally misaligned around the central axis of the downhole tool, and wherein for each arm the first and second pivot joints are located on a first side of the plane; and a third pivot joint offset from the plane and located on a second side of the plane.

2. The apparatus of claim 1 wherein each arm is operable to move radially with respect to the central axis of the downhole tool to move at least a portion of the tool string substantially perpendicularly with respect to a central axis of the downhole passage to centralize within the downhole passage the at least a portion of the tool string.

3. The apparatus of claim 1 wherein the second support member is operable to move axially to facilitate movement of the arms against a sidewall of the downhole passage.

4. The apparatus of claim 1 wherein the arms are operable to:

move against a sidewall of the downhole passage to centralize at least a portion of the tool string within the downhole passage;

impart an intended force against the sidewall of the downhole passage; and maintain the intended force substantially constant while the tool string is conveyed along the downhole passage and an inner diameter of the downhole passage changes.

5. The apparatus of claim 4 wherein the intended force is an intended radial force, and wherein the second support member is operable to:

move axially to facilitate movement of the arms against the sidewall of the downhole passage; and apply a changing axial force to the arms to maintain the intended radial force substantially constant while the tool string is conveyed along the downhole passage and the inner diameter of the downhole passage changes.

6. The apparatus of claim 1 wherein the second support member is operable to move axially to facilitate movement of the arms against a sidewall of the downhole passage, and wherein the arms are operable to:

move against the sidewall of the downhole passage to centralize at least a portion of the tool string within the downhole passage;

impart an intended force against the sidewall of the downhole passage; and maintain the intended force substantially constant while the tool string is conveyed along the downhole passage and an inner diameter of the downhole passage changes.

7. An apparatus comprising:

a downhole tool operable to be coupled with a tool string and conveyed within a downhole passage, wherein the downhole passage is a wellbore or a tubular member disposed in the wellbore, and wherein the downhole tool comprises:

a plurality of arms;

a first piston operatively connected with the arms and operable to cause the arms to move against a sidewall of the downhole passage to centralize at least a portion of the tool string within the downhole passage when the first piston is moved by hydraulic fluid; and a second piston operatively connected with the arms, wherein the first and second pistons are operatively connected with each other via a flexible member.

8. The apparatus of claim 7 wherein the first piston is further operable to cause the arms to:

impart an intended radial force against the sidewall of the downhole passage; and maintain the intended radial force substantially constant while the tool string is conveyed along the downhole passage and an inner diameter of the downhole passage changes.

9. The apparatus of claim 8 wherein the first piston is further operable to apply a changing axial force to the arms to maintain the intended radial force substantially constant while the tool string is conveyed along the downhole passage and the inner diameter of the downhole passage changes.

10. The apparatus of claim 8 wherein:

the downhole tool further comprises:

a static support member; and a movable support member operatively connected with the second piston;

each arm comprises:

a first arm member pivotably connected with the static support member; and a second arm member pivotably connected with the movable support member; and the first piston is further operable to apply a changing axial force to the movable support member to maintain the intended radial force substantially constant while the tool string is conveyed along the downhole passage and the inner diameter of the downhole passage changes.

11. The apparatus of claim 8 wherein the downhole tool further comprises a pressure sensor operable to output a signal or information indicative of pressure of the hydraulic fluid, and wherein the downhole tool is further operable to change the pressure of the hydraulic fluid to maintain the intended radial force substantially constant while the tool string is conveyed along the downhole passage and the inner diameter of the downhole passage changes.

12. The apparatus of claim 8 wherein the downhole tool further comprises a position sensor operable to output signals or information indicative of position of the first piston and thus of the arms, and wherein the downhole tool is further operable to change pressure of the hydraulic fluid based on the signals or information to maintain the intended radial force substantially constant while the tool string is conveyed along the downhole passage and the inner diameter of the downhole passage changes.

13. The apparatus of claim 8 wherein the downhole tool further comprises:

a hydraulic pump operable to pressurize the hydraulic fluid; and a hydraulic fluid control valve fluidly connected with the hydraulic pump, wherein the hydraulic pump and/or the hydraulic fluid control valve are operable to change pressure of the hydraulic fluid to maintain the intended radial force substantially constant while the tool string is conveyed along the downhole passage and the inner diameter of the downhole passage changes.

14. The apparatus of claim 7 wherein the downhole tool further comprises a housing, wherein the first and second pistons are slidably disposed within the housing, and wherein the housing is configured to receive the hydraulic fluid thereby causing:

the first and second pistons to move axially; and the arms to move radially against the sidewall of the downhole passage.

15. The apparatus of claim 7 wherein the downhole tool further comprises a plurality of Hall effect sensors disposed adjacent to the first piston, and wherein the Hall effect sensors are collectively operable to output signals or information indicative of position of the first piston.

16. The apparatus of claim 15 wherein the downhole tool further comprises:

a housing; and a chamber within the housing, wherein the first piston is slidably disposed within the chamber, and wherein the Hall effect sensors are distributed alongside the chamber within a wall of the housing.

17. An apparatus comprising:

a downhole tool operable to be coupled with a tool string and conveyed within a downhole passage, wherein the downhole passage is a wellbore or a tubular member disposed in the wellbore, and wherein the downhole tool comprises:

a first support member;

a second support member; and a plurality of arms, wherein each arm comprises:

a first arm member pivotably connected with the first support member via a first pivot joint; and a second arm member pivotably connected with the second support member via a second pivot joint, wherein for each arm the first and second pivot joints are:

offset from a plane coinciding with a central axis of the downhole tool;

located on the same side of the plane; and azimuthally misaligned around the central axis of the downhole tool.

18. The apparatus of claim 17 wherein the first and second arm members are pivotably connected via a third pivot joint, and wherein the third pivot joint is offset from and located on a side of the plane opposite from the side on which the first and second pivot joints are located.

19. The apparatus of claim 17 wherein the second support member is operable to move axially to facilitate movement of the arms against a sidewall of the downhole passage, and wherein the arms are operable to:

move against the sidewall of the downhole passage to centralize at least a portion of the tool string within the downhole passage;

impart an intended force against the sidewall of the downhole passage; and maintain the intended force substantially constant while the tool string is conveyed along the downhole passage and an inner diameter of the downhole passage changes.

20. An apparatus comprising:

a downhole tool operable to be coupled with a tool string and conveyed within a downhole passage, wherein the downhole passage is a wellbore or a tubular member disposed in the wellbore, and wherein the downhole tool comprises:

a first support member;

a second support member; and a plurality of arms, wherein each arm comprises:

a first arm member pivotably connected with the first support member via a first pivot joint; and a second arm member pivotably connected with the second support member via a second pivot joint, wherein for each arm:

the first and second pivot joints are offset from a first plane coinciding with a central axis of the downhole tool;

the first and second pivot joints are located on the same side of the first plane;

the first pivot joint is located on a first side of a second plane coinciding with the central axis of the downhole tool; and the second pivot joint is located on a second side of the second plane opposite the first side of the second plane, wherein the first and second planes extend substantially perpendicularly with respect to each other.

21. The apparatus of claim 20 wherein the first and second arm members are pivotably connected via a third pivot joint, and wherein the third pivot joint is offset from and located on a side of the first plane opposite from the side on which the first and second pivot joints are located.

22. The apparatus of claim 20 wherein the second support member is operable to move axially to facilitate movement of the arms against a sidewall of the downhole passage, and wherein the arms are operable to:

move against the sidewall of the downhole passage to centralize at least a portion of the tool string within the downhole passage;

impart an intended force against the sidewall of the downhole passage; and maintain the intended force substantially constant while the tool string is conveyed along the downhole passage and an inner diameter of the downhole passage changes.

23. An apparatus comprising:

a downhole tool operable to be coupled with a tool string and conveyed within a downhole passage, wherein the downhole passage is a wellbore or a tubular member disposed in the wellbore, and wherein the downhole tool comprises:

a first support member;

a second support member; and a plurality of arms, wherein each arm comprises:

a first arm member pivotably connected with the first support member via a first pivot joint;

a second arm member pivotably connected with the second support member via a second pivot joint; and a third pivot joint, wherein for each arm:

the first and second pivot joints are offset from a first plane coinciding with a central axis of the downhole tool;

the first and second pivot joints are located on a first side of the first plane;

the third pivot joint is offset from the first plane and located on a second side of the first plane;

the first pivot joint is located on a first side of a second plane coinciding with the central axis of the downhole tool; and the second pivot joint is located on a second side of the second plane opposite the first side of the second plane, wherein the first and second planes extend substantially perpendicularly with respect to each other.

24. The apparatus of claim 23 wherein the second support member is operable to move axially to facilitate movement of the arms against a sidewall of the downhole passage, and wherein the arms are operable to:

move against the sidewall of the downhole passage to centralize at least a portion of the tool string within the downhole passage;

impart an intended force against the sidewall of the downhole passage; and maintain the intended force substantially constant while the tool string is conveyed along the downhole passage and an inner diameter of the downhole passage changes.

* * * * *